US009777602B2

(12) United States Patent
Juchymenko

(10) Patent No.: US 9,777,602 B2
(45) Date of Patent: Oct. 3, 2017

(54) SUPPLEMENTARY THERMAL ENERGY TRANSFER IN THERMAL ENERGY RECOVERY SYSTEMS

(76) Inventor: Victor Juchymenko, Calgary (CA)

( * ) Notice: Subject to any disclaimer, the term of this patent is extended or adjusted under 35 U.S.C. 154(b) by 999 days.

(21) Appl. No.: 12/554,853

(22) Filed: Sep. 4, 2009

(65) Prior Publication Data

US 2009/0320477 A1 Dec. 31, 2009

Related U.S. Application Data

(63) Continuation-in-part of application No. PCT/CA2008/000402, filed on Mar. 3, 2008.

(30) Foreign Application Priority Data

Aug. 24, 2009 (CA) ..... 2679612

(51) Int. Cl.

| | |
|---|---|
| ***F01K 25/08*** | (2006.01) |
| ***F01K 23/02*** | (2006.01) |
| ***F01K 23/06*** | (2006.01) |
| ***F01K 25/10*** | (2006.01) |

(52) U.S. Cl.

CPC ..... *F01K 23/02* (2013.01); *F01K 23/065* (2013.01); *F01K 25/10* (2013.01)

(58) Field of Classification Search

CPC ..... F01K 23/02; F01K 25/10; F04D 29/5833; F25J 2230/60

USPC ..... 60/616–624, 651, 671, 676

See application file for complete search history.

(56) References Cited

U.S. PATENT DOCUMENTS

| | | | | |
|---|---|---|---|---|
| 4,182,127 | A * | 1/1980 | Johnson | 60/618 |
| 4,184,325 | A * | 1/1980 | Mandrin | F01K 23/10 122/7 R |
| 4,228,657 | A | 10/1980 | Leo | |
| 4,271,664 | A | 6/1981 | Earnest | |
| 4,876,856 | A * | 10/1989 | Iishiki | F01D 15/005 60/651 |
| 4,901,531 | A | 2/1990 | Kubo et al. | |
| 5,000,003 | A | 3/1991 | Wicks | |
| 5,056,601 | A * | 10/1991 | Grimmer | F01P 3/20 123/41.33 |

(Continued)

FOREIGN PATENT DOCUMENTS

| | | |
|---|---|---|
| CA | 2425433 A1 | 4/2003 |
| CA | 2505600 | 5/2004 |

(Continued)

*Primary Examiner* — Jonathan Matthias
*Assistant Examiner* — Jason Sheppard
(74) *Attorney, Agent, or Firm* — Loza & Loza, LLP; Peter Zura

(57) ABSTRACT

A system for controlled recovery of thermal energy and conversion to mechanical energy. The system collects thermal energy from a reciprocating engine (for example, from engine jacket fluid) and may also collect further thermal energy from a natural gas compressor (for example, from compressor lubricating fluid). The collected thermal energy is used to generate secondary power by evaporating an organic propellant and using the gaseous propellant to drive an expander in production of mechanical energy. Secondary power is used to power parasitic loads, improving energy efficiency of the system. A supplementary cooler may provide additional cooling capacity without compromising system energy efficiency.

48 Claims, 13 Drawing Sheets

(56) References Cited

U.S. PATENT DOCUMENTS

| | | | | |
|---|---|---|---|---|
| 5,440,882 | A | 8/1995 | Kalina | |
| 6,151,891 | A * | 11/2000 | Bennett | 60/298 |
| 6,470,683 | B1 * | 10/2002 | Childs et al. | 60/641.8 |
| 6,739,389 | B2 * | 5/2004 | Nakagawa | F02G 5/02 165/11.1 |
| 6,751,959 | B1 * | 6/2004 | McClanahan et al. | 60/670 |
| 6,986,251 | B2 | 1/2006 | Radcliff et al. | |
| 7,469,540 | B1 * | 12/2008 | Knapton et al. | 60/618 |
| 7,520,133 | B2 * | 4/2009 | Hoetger | F01K 23/065 60/614 |
| 7,637,108 | B1 * | 12/2009 | Langson | 60/616 |
| 2007/0245733 | A1 * | 10/2007 | Pierson et al. | 60/651 |
| 2009/0158736 | A1 * | 6/2009 | Mierisch | 60/641.8 |
| 2010/0146974 | A1 * | 6/2010 | Ast et al. | 60/671 |

FOREIGN PATENT DOCUMENTS

| | | | |
|---|---|---|---|
| EP | 0015208 | A1 | 9/1980 |
| FR | 2885169 | A1 | 11/2006 |
| WO | WO/2006/138459 | | 12/2006 |

* cited by examiner

SUPPLEMENTARY THERMAL ENERGY TRANSFER IN THERMAL ENERGY RECOVERY SYSTEMS

This application is a continuation-in-part of PCT/CA2008/000402 filed Mar. 3, 2008. This application claims the benefit of Canadian Application No.: 2679612 filed Aug. 24, 2009. These applications are hereby incorporated by reference.

BACKGROUND OF THE INVENTION

The present invention relates generally to thermal energy recovery systems. More particularly, the present invention relates to the efficient, controlled operation of an Organic Rankine Cycle (ORC) system in which waste heat is recovered from a reciprocating engine and/or a natural gas compressor coupled to a reciprocating engine.

Methods for implementing a Rankine cycle within a system to recover thermal energy from a heat source are well known. Although most waste heat recovery systems were initially developed to produce steam that could be used to drive a steam turbine, the basic principles of the Rankine cycle have since been extended to lower temperature applications by the use of organic propellants within the system. Such ORC systems are typically used within thermal energy recovery systems or geothermal applications, in which heat is converted into mechanical energy that can be used to generate electrical energy. As such, these systems have become particularly useful in heat recovery and power generation—collecting heat from turbine engine exhaust, combustion processes, geothermal sources, solar thermal energy collectors, and thermal energy from other industrial sources.

Generally, a Rankine-based heat recovery system includes a propellant pump for circulating propellant throughout the system, an evaporator for evaporating propellant that has become heated by collection of waste heat, an expander (typically a turbo-expander) through which evaporated propellant is allowed to expand and create power or perform work, and a condenser for cooling the propellant back to liquid state so it may be pumped to again collect heat and repeat the cycle. The basic Rankine cycle has been adapted for collection of heat from various sources, with conversion of the heat energy to other energy outputs.

For example, U.S. Pat. No. 5,440,882 describes a method for using geothermal energy to drive a modified ORC based system that uses an ammonia and water mixture as the propellant. The evaporated working fluid is used to operate a second turbine, generating additional power. Heat is conserved within the Rankine cycle portion of the system through the use of a recuperator heat exchanger at the working fluid condensation stage.

U.S. Pat. No. 6,986,251 describes an ORC system for extracting waste heat from several sources in a reciprocating engine system. A primary propellant pump drives the Rankine cyde with assistance from the auxiliary booster pump, to limit pump speeds and avoid cavitation. When the Rankine cycle is inactive (e.g. due to reciprocating engine failure or maintenance), the auxiliary pump continues to operate alone, circulating propellant until the propellant and system components have cooled sufficiently for complete shut down. Diversions are present to prevent circulation of propellant through the evaporator and through the turbine during this cooling cycle.

U.S. Pat. No. 4,228,657 describes the use of a screw expander within a Rankine cycle system. The screw expander is used to expand a propellant, and waste heat is further extracted from the expander in order to improve system efficiency. A geothermal well supplies pressurized hot water or brine as the heat source.

When using organic propellants within a Rankine cycle, care must be taken to avoid exposure of the propellants to flame. Although specialized organic propellants having high flash temperatures (for example Genetron® R-245fa, which is 1,1,1,3,3-pentafluoropropane) have been developed, the danger of combustibility still exists, as engine exhaust may reach temperatures up to 1200 degrees F. Further, the purchase of proprietary propellants adds a significant cost to these systems and requires the ORC system to be in close proximity to the heat source.

A common problem particularly relevant to recovery of thermal energy is that when using air-cooled condensers, ambient air temperatures significantly impact the ORC system efficiency and total power generated. Applicant's co-pending application, WO 2008/106774, describes a robust configuration and associated operation of an ORC system, with heat collection from various waste heat sources driving evaporation of propellant to provide secondary energy output. This secondary power may be used to directly power parasitic loads within the system, enabling independent control and operation of these loads, improving system efficiency. One notable application of this system lies in the compression of natural gas at both on-grid and off-grid sites for pipeline transport, with the reciprocating engine driving the natural gas compressor.

Published application WO 2006/138459 describes an ORC system in which an organic propellant is used to remove heat from the engine.

Retrofitted systems for recovering heat from a reciprocating engine are generally limited by pre-existing space constraints and site conditions, particularly when used in remote locations. Generally, heat recovery systems of the prior art require close proximity to the engine, liquid condensing, expensive components, do not incorporate a recuperator (economizer) and are not sufficiently adaptable to recover and utilize thermal energy from other sources, if present.

SUMMARY OF INVENTION

It is an object of the present invention to obviate or mitigate at least one disadvantage of previous Rankine-based heat recovery systems.

In a first aspect, there is provided a system for collection and conversion of thermal energy to mechanical energy, the system comprising: a reciprocating engine operable to provide a primary power source and a first source of thermal energy; a circulating pump, at least one propellant heat exchanger, an expander, and a condenser, arranged to operate an Organic Rankine Cycle (ORC) in which thermal energy from said first source of thermal energy is transferred to a liquid organic propellant in the propellant heat exchanger to evaporate the propellant, which expansion of gaseous propellant then drives the expander in production of mechanical energy to create secondary power, with spent propellant from the expander condensed back into liquid form by the condenser for recirculation to the heat exchanger; a cooler comprising a cooling fluid circulating through a supplementary heat exchanger, the supplementary heat exchanger operatively located within the ORC system between the expander and the condenser to provide supplementary propellant cooling capacity; and a control module for regulating operation of the Rankine cycle and supplementary cooler to maximize secondary power generation.

In an embodiment, the first source of thermal energy comprises engine cooling fluid. For example, the engine cooling fluid may be engine jacket fluid or auxiliary cooling fluid.

In an embodiment, when the first source of thermal energy is engine jacket fluid, the cooling fluid circulating through the supplementary heat exchanger may also be engine jacket fluid. Further, in such embodiment, the engine jacket fluid may be overcooled at the propellant heat exchanger to transfer an excess of thermal energy to propellant, and the engine jacket fluid may then be reheated at the cooler prior to circulation back to the engine jacket.

In another embodiment, the first source of thermal energy comprises a combination of engine cooling fluid and engine exhaust.

In another embodiment, the system further comprises an engine radiator, wherein cooling fluid from the cooler is circulated to the radiator to dissipate thermal energy transferred to the cooling fluid from propellant at the supplementary heat exchanger.

In an additional embodiment, the cooler further comprises a ground source heat exchange conduit, whereby heat transferred from the propellant to the cooling fluid at the supplementary heat exchanger is dissipated by circulation of the cooling fluid through the ground source heat exchange conduit.

Further, the system may further comprising a second source of thermal energy, and a second source heat exchanger for transferring thermal energy from the second source of thermal energy directly or indirectly to the propellant. The second source of thermal energy may be, for example, engine exhaust, or a natural gas compressor operatively associated with the engine. When the second source of thermal energy is a natural gas compressor, thermal energy may be collected, for example, from lubricating fluid circulating within the compressor, and/or from compressed natural gas conduits associated with the compressor.

In any embodiment, thermal energy may be transferred directly or indirectly to propellant within the ORC. For example, thermal energy from a second source of thermal energy may be first transferred to an intermediate fluid, which transfers thermal energy to the propellant. When the first source of thermal energy is engine jacket fluid, thermal energy from the second source may be transferred to the engine jacket fluid to further increase the thermal energy content of the jacket fluid prior to the engine jacket fluid circulating to the propellant heat exchanger.

In further embodiments, the system comprises additional sources of thermal energy, and corresponding heat exchangers for transferring thermal energy directly or indirectly to the propellant. Some examples of appropriate sources of thermal energy include: engine jacket fluid, engine auxiliary cooling fluid, engine exhaust, natural gas compressor lubricating fluid, and natural gas conduits.

In another embodiment, a system parasitic load is powered with secondary power during operation of the ORC. For example, the parasitic load may be a cooling fan for cooling one or more system components selected from the group consisting of: propellant conduits, engine fluid conduits, and natural gas conduits. Further, two or more system may be co-located in proximity to the cooling fan so as to be simultaneously cooled by the fan using secondary power.

In accordance with a further aspect, there is provided a system for collection and conversion of thermal energy to mechanical energy, the system comprising: a reciprocating engine operable to provide a primary power source; an engine cooling system comprising engine jacket fluid circulating about the engine, and an engine auxiliary cooling system comprising auxiliary cooling system fluid circulating about the engine; a circulating pump, at least one propellant heat exchanger, an expander, and a condenser, arranged to operate an Organic Rankine Cycle (ORC) in which an excess of thermal energy from the engine jacket fluid is transferred to a liquid organic propellant at the propellant heat exchanger to evaporate the propellant, which gaseous propellant then drives the expander in production of mechanical energy to create secondary power, with spent propellant from the expander condensed back into liquid form by the condenser for recirculation to the heat exchanger; a supplementary heat exchanger for transferring thermal energy from the auxiliary cooling system fluid to the engine jacket fluid to reheat the engine jacket fluid prior to circulation of the engine jacket fluid to the reciprocating engine; and a control module for regulating operation of the Rankine cycle and supplementary heat exchanger.

In a further aspect, there is provided a system for collection and conversion of thermal energy to mechanical energy, the system comprising: a natural gas compressor operable to compress natural gas within natural gas conduits, the natural gas compressor providing a first source of thermal energy; a circulating pump, one or more heat exchangers, an expander, and a condenser, arranged to operate an ORC in which thermal energy is transferred directly or indirectly to a liquid organic propellant using the one or more heat exchangers to evaporate the propellant, which gaseous propellant then drives the expander in production of mechanical energy to create secondary power, with spent propellant from the expander condensed back into liquid form by the condenser for recirculation to the heat exchanger; and a control module for regulating operation of the Rankine cycle to maximize secondary power generation.

In an embodiment, the condenser comprises cooling fluid circulating through a supplementary heat exchanger. For example, the cooling fluid may be continuous with a ground source heat exchange conduit, whereby heat transferred from the propellant to the cooling fluid at the condenser is dissipated by circulation of the cooling fluid through the ground source heat exchange conduit.

In an embodiment, a system parasitic load is powered with secondary power during operation of the ORC. The parasitic load may be a cooling fan for cooling one or more system components selected from the group consisting of: propellant conduits, compressor lubricating fluid, and natural gas conduits. Two or more system components may be co-located in proximity to the cooling fan so as to be simultaneously cooled by the fan using secondary power.

In an embodiment, the first source of thermal energy comprises compressor lubricating fluid. The first source of thermal energy may further comprise a heat transfer fluid circulating about the natural gas conduits.

In an embodiment, the first source of thermal energy comprises a heat transfer fluid circulating about the natural gas conduits.

In an embodiment, the compressor is powered by a reciprocating engine, the reciprocating engine providing a second source of thermal energy, which may be engine cooling fluid. For example, the engine cooling fluid may be engine jacket fluid or engine auxiliary cooling fluid.

In an embodiment, the second source of thermal energy comprises engine exhaust.

In an embodiment, thermal energy from the first or second source of thermal energy is transferred to an intermediate fluid, which transfers thermal energy to the propellant. For example, the intermediate fluid may be engine jacket fluid or engine auxiliary cooling fluid.

In an embodiment, the second source of thermal energy is engine cooling fluid, and thermal energy from the first source of thermal energy is transferred to the engine cooling fluid to further increase the thermal energy content of the engine cooling fluid prior to the engine cooling fluid circulating to the propellant heat exchanger. In certain embodiments, the engine cooling fluid may be engine jacket fluid or engine auxiliary cooling fluid.

In an embodiment, the second source of thermal energy is compressor lubricating fluid.

In another embodiment, the system further comprises a cooler, the cooler comprising a cooling fluid circulating through a supplementary heat exchanger, the supplementary heat exchanger operatively located within the ORC between the expander and the condenser to provide supplementary propellant cooling capacity. Further, the system may further comprise a reciprocating engine for powering the natural gas compressor, wherein the cooling fluid is cooled engine jacket fluid from which an excess of engine heat has been transferred at the propellant heat exchanger.

In an embodiment, the engine comprises a radiator, and propellant heat transferred to the jacket fluid is dissipated by circulation of the jacket fluid through the radiator.

The cooler may further comprises a ground source heat exchange conduit, whereby heat transferred from the propellant to the cooling fluid at the supplementary heat exchanger is dissipated by circulation of the cooling fluid through the ground source heat exchange conduit.

In another aspect, there is provided a method for heating propellant within an ORC system, the ORC system associated with a natural gas compressor powered by a reciprocating engine, the method comprising the steps of: collecting waste thermal energy from the reciprocating engine within a heat transfer fluid; collecting waste thermal energy from the natural gas compressor by circulation of compressor lubricating fluid about the compressor; circulating each of the heat transfer fluid and compressor lubricating fluid to one or more heat exchangers to facilitate direct or indirect transfer of engine and compressor thermal energy to propellant circulating within the ORC.

In an embodiment, the method further comprises the steps of: collecting a further amount of thermal energy from compressed natural gas conduits associated with the natural gas compressor; and transferring the further amount of thermal energy directly or indirectly to the propellant.

In another embodiment, thermal energy from the compressor lubricating fluid is transferred to the heat transfer fluid at a first heat exchanger to increase the thermal energy content of the heat transfer fluid; and then the heat transfer fluid is circulated to a second heat exchanger to transfer thermal energy to the propellant.

In an embodiment, the heat transfer fluid is engine jacket fluid. In another embodiment, the heat transfer fluid is engine auxiliary cooling fluid.

The method may further comprise the step of reheating the heat transfer fluid following heat exchange with propellant.

In an embodiment, the step of reheating the heat transfer fluid comprises heat exchange with propellant in the ORC at a location between the expander and the condenser.

In an embodiment, the step of reheating the heat transfer fluid comprises heat exchange with heated auxiliary cooling fluid.

In an embodiment, the step of reheating the heat transfer fluid comprises heat exchange with engine exhaust.

In another aspect, there is provided a method for providing supplementary propellant cooling capacity in an ORC system, the method comprising the steps of: providing a cooler comprising a cooling fluid circulating through a supplementary heat exchanger located downstream of an ORC expander; circulating heated propellant to the supplementary heat exchanger to transfer propellant heat to the cooling fluid, for assisting in condensation of propellant within the ORC system; dissipating transferred heat from the cooling fluid; and recirculating the cooling fluid to the supplementary heat exchanger.

In an embodiment, the cooling fluid is engine jacket fluid, and wherein the step of dissipating heat from the cooling fluid comprises transferring an excess of thermal energy from the engine jacket fluid to the propellant at the propellant heat exchanger to reduce the thermal energy of the jacket water below that which is acceptable for return to the engine.

In another embodiment, the engine comprises a radiator, and wherein the step of dissipating heat from the cooling fluid comprises circulation of the cooling fluid through the engine radiator.

In another embodiment, the step of dissipating heat from the cooling fluid comprises circulation of the cooling fluid through a ground source heat exchange conduit.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a method and system to recover and dissipate thermal energy from a reciprocating engine and/or a natural gas compressor, through controlled operation of an ORC system to produce secondary power. Various configurations are provided to maximize efficiency of the Rankine cycle and secondary energy output in various applications. With improvements in efficiency and increased generation of secondary power, system resources may be further allocated to heating and/or cooling the organic propellant, allowing for more efficient operation of the ORC system and/or increased secondary power generation.

Generally, an ORC system is provided in which thermal energy is collected from a reciprocating engine and/or a natural gas compressor, and used to produce secondary power. Accordingly, thermal energy may be collected from one or more of the following sources and transferred to propellant: engine jacket fluid, engine auxiliary cooling fluid, engine exhaust, natural gas compressor lubricating fluid, and natural gas conduits.

Similarly, supplementary cooling may be provided to the ORC system to assist in condensation of propellant exiting the expander. For example, cooling may be provided by heat transfer from propellant to one of the following cooling fluids: overcooled engine jacket fluid, overcooled auxiliary cooling fluid, a ground source heat transfer fluid, or a further amount of engine jacket or auxiliary fluid that is cooled at an otherwise underutilized corresponding radiator.

Overview

Figure 1:
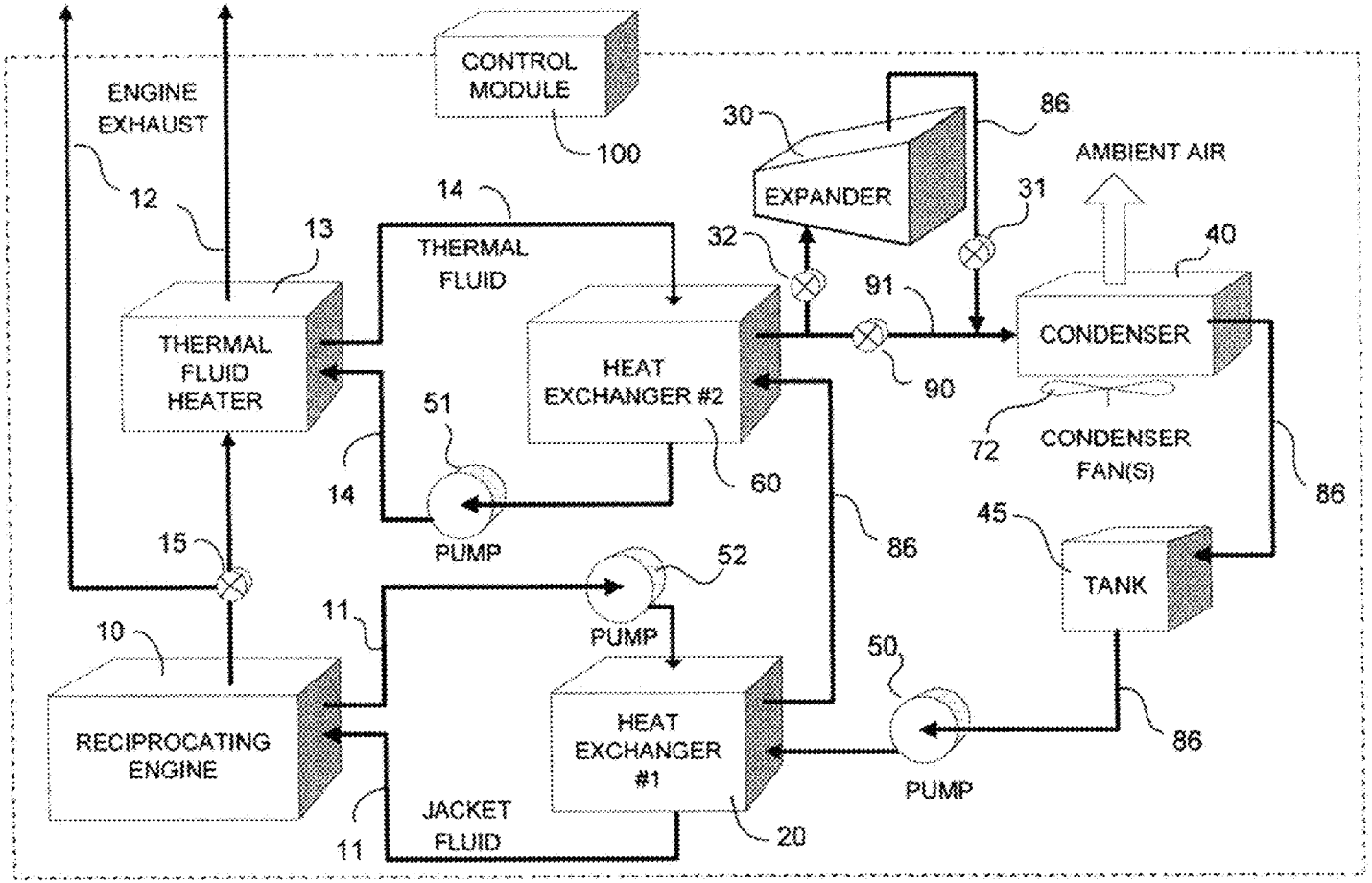
FIG. 1 is a schematic diagram of an ORC system coupled to a reciprocating engine.

With reference to FIG. 1, a reciprocating engine 10 provides a primary power source, releasing thermal energy through engine exhaust 12 and as radiant energy. The radiant energy is typically dissipated from the engine block by heat transfer within the engine jacket (housing) to an engine cooling fluid circulating within the engine jacket 11. In the present system, the thermal energy collected by the circulating jacket fluid 11 (typically a glycol and water mixture) is transferred to organic propellant within the Rankine cycle through a first heat exchanger 20 to either preheat or evaporate the propellant, depending on the type of propellant used and the degree of heat exchange permitted. Circulation of jacket fluid may be assisted using a booster pump 52, as required. Thermal energy collection from the engine jacket fluid may be supplemented or replaced by heat collection and exchange from the engine auxiliary cooling fluid system.

The preheated or evaporated organic propellant 86 may collect additional thermal energy from engine exhaust 12 through circulation (by pump 51) of a thermal fluid 14 between an exhaust thermal fluid heater 13 and propellant heat exchanger 60. This circulation will result in evaporation or superheating of propellant 86 prior to delivery to the expander 30. Propellant 86 is then condensed back to liquid state by condenser 40 and stored in tank 45 such that the propellant is available to feed the circulating pump 50 to circulate the propellant 86 back to heat exchangers 20 and/or 60.

Figure 2:
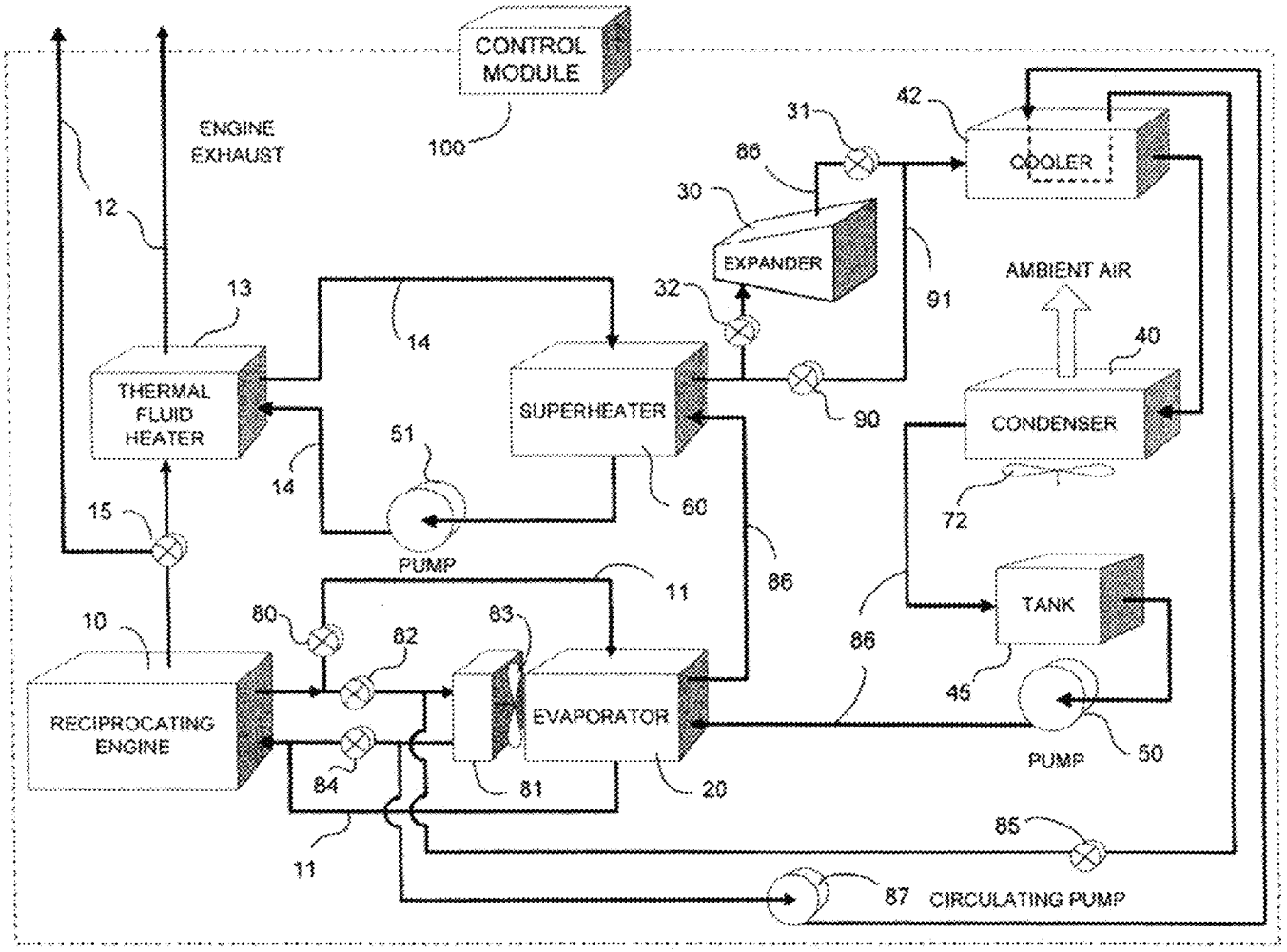
FIG. 2 is a schematic diagram of an ORC system coupled to a reciprocating engine, the ORC system including a supplementary cooling fluid continuous with an engine radiator.
Figure 4:
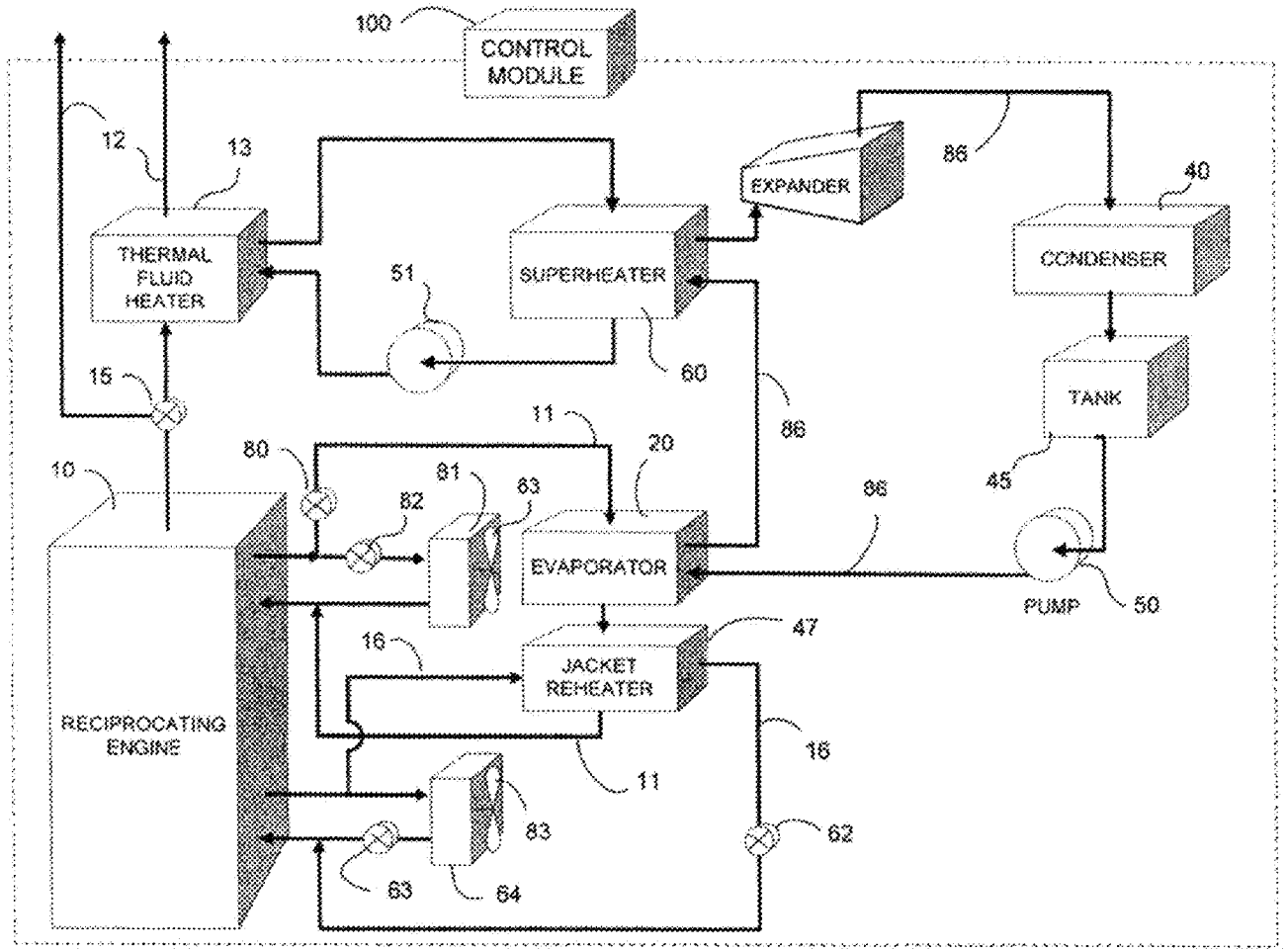
FIG. 4 is a schematic diagram of an ORC system coupled to a reciprocating engine, the ORC system including a ground source heat exchange condenser.

With reference to FIG. 2 through to FIG. 4, additional cooling capacity is provided to the ORC system through:

1) leveraging underutilized engine radiator capacity to cool a supplementary amount of engine cooling fluid (for example engine jacket water 11 or engine auxiliary cooling fluid 16) for heat exchange with propellant at liquid cooler 42 (see FIG. 2),
2) increasing heat transfer from an engine cooling fluid at the first heat exchanger 20 and using this overcooled engine cooling fluid for heat exchange with propellant at liquid cooler 42, thereby cooling the propellant to assist condensation, and reheating the overcooled engine cooling fluid (either engine jacket water 11 or engine auxiliary cooling fluid 16)(see FIG. 3),
3) a ground source heat exchange system for use in condensing or otherwise cooling propellant (see FIG. 4).

Figure 5:
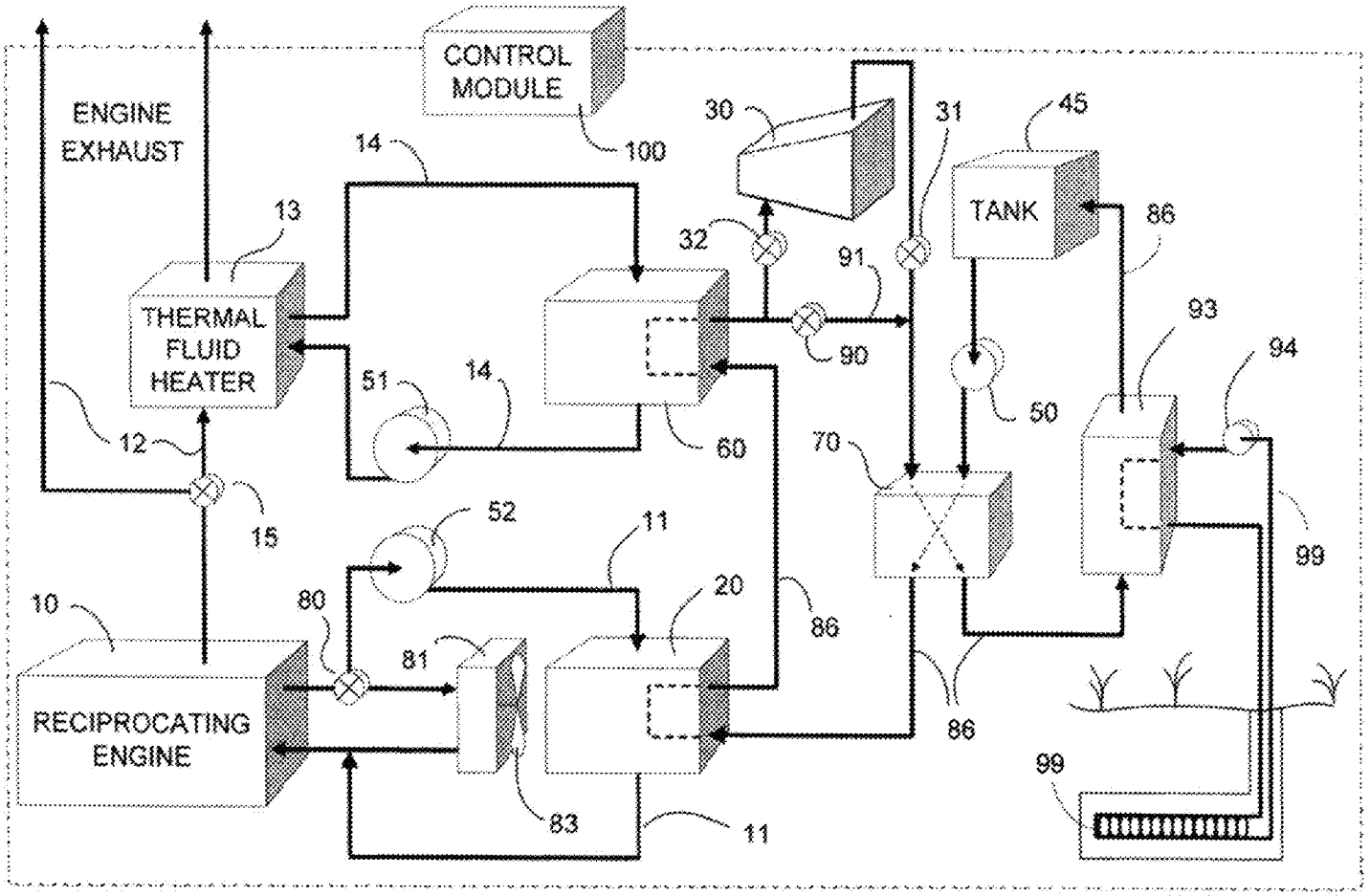
FIG. 5 is a schematic diagram of an ORC system coupled to a reciprocating engine, in which engine jacket fluid passes from the first heat exchanger, at which propellant is heated, to a supplementary heat exchanger continuous with engine auxiliary cooling fluid.
Figure 7:
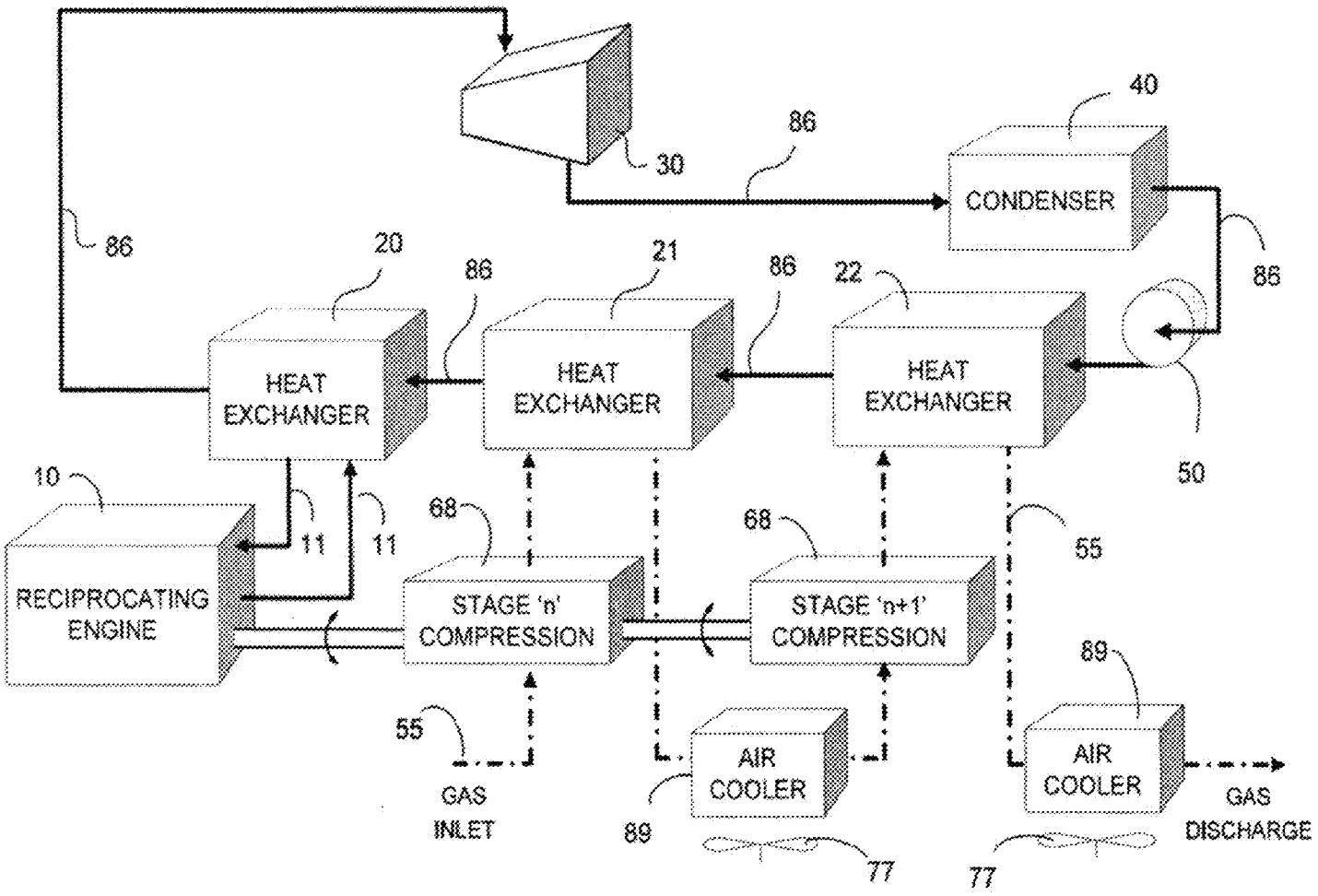
FIG. 7 is a schematic diagram of an ORC system for heat recovery during natural gas compression.
Figure 8:
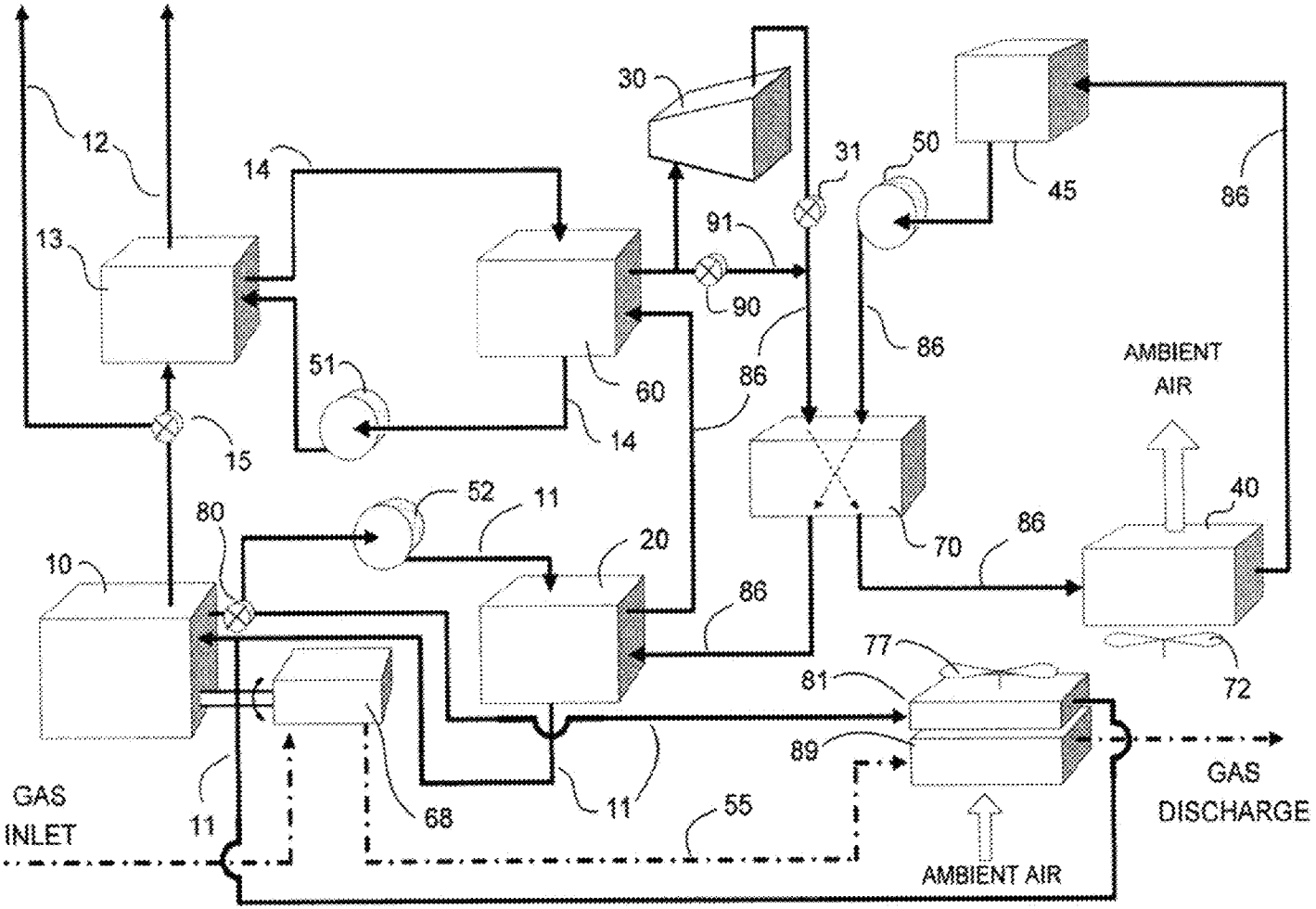
FIG. 8 is a schematic diagram of a prior art method of dissipating heat from the lubricating oil of a natural gas compressor.
Figure 13:
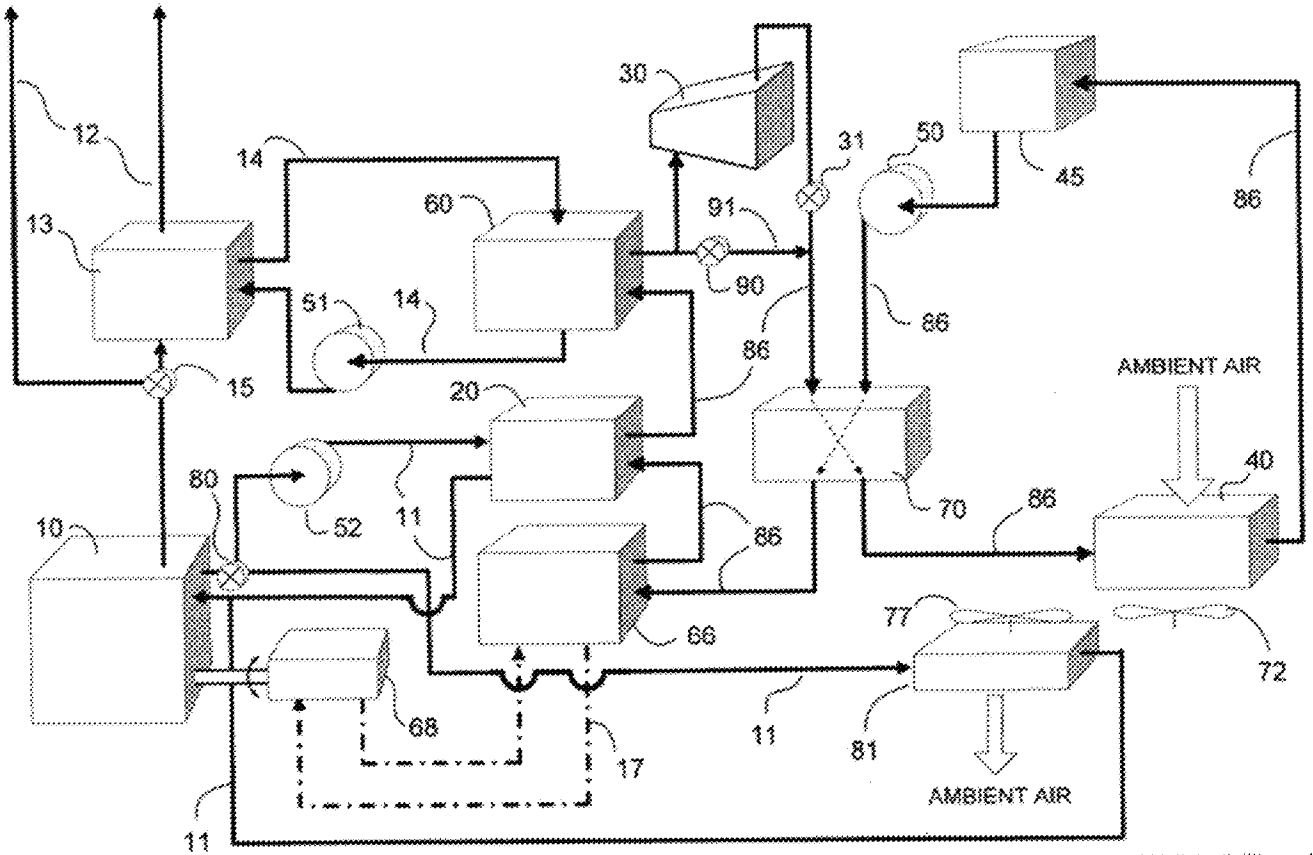
FIG. 13 is a schematic diagram of an ORC system for recovering waste heat from a reciprocating engine and natural gas compressor, in which waste heat from the lubrication oil of the natural gas compressor is transferred directly to the ORC propellant, and including a supplementary cooler.

With reference to FIG. 5 through to FIG. 13, additional heating capacity may be provided to the system through:

1) increasing heat transfer from the engine jacket fluid 11 at heat exchanger 20, and then reheating the overcooled fluid with heat collected from the engine auxiliary cooling fluid system at a further heat exchanger 47 (see FIG. 5);
2) when the reciprocating engine is coupled to a natural gas compressor 68, collecting thermal energy from any combination of: engine exhaust 12; radiant energy from the engine collected in engines jacket cooling fluid 11 or the engine auxiliary cooling fluid system 16; radiant energy collected in the compressed natural gas 55 (FIGS. 6 and 7) and, radiant energy collected in the lubricating oil 17 of the compressor (FIG. 8 through to FIG. 13).

As described above, radiant energy from the engine is typically dissipated from the engine block by heat transfer within the engine jacket (housing) to a cooling fluid circulating within the engine jacket. The fluid being circulated within the engine jacket is typically referred to as engine jacket water/fluid. This thermal energy from engine jacket fluid may instead be transferred directly or indirectly to the organic propellant of the ORC system. Similarly, in the compressor 68, the thermal energy available in the compressed natural gas 55 is typically dissipated to the atmosphere through air exchangers 89 (see FIG. 6) and the lubricating oil 17 is typically dissipated via heat transfer to either the engines jacket cooling fluid 11 and then dissipated through radiator 81 or transferred to the engine auxiliary cooling fluid system 16 on the reciprocating engine and then dissipated through the radiator 64 (see FIG. 8), but may instead by transferred directly (FIGS. 10, 11, 12 and 13) or transferred indirectly (FIG. 9—lubricating oil to engine jacket water or engine auxiliary cooling fluid system) to the organic propellant of the ORC system. Notably, the thermal energy from compressed natural gas 55, lubricating oil 17, the engines exhaust 12, the engine jacket fluid 11, and or the engines auxiliary cooling fluid 16, or any combination thereof, can be used to preheat, evaporate, and in some cases superheating the propellant 86, depending on the type of propellant used and the degree of heat exchange available.

Thermal energy may also be collected from the engine auxiliary cooling fluid system (typically used to cool the turbo after-cooler) with or without the additional waste heat from the natural gas compressor, for direct or indirect transfer to organic propellant at any appropriate point in the ORC system prior to delivery of propellant to the expander 30.

Controlled circulation of evaporated or superheated propellant 86 through the expander 30 drives generation of secondary power, which may be converted to electric power and used on site as required, or may be used as shaft power to drive other devices such as on-site compressors or pumps. The spent propellant exiting the expander 30 is condensed at condenser 40, passes through storage tank 45, and then to pump 50 prior to returning to the heat exchanger 20 to repeat the cycle. A control module 100, although not shown in all Figures, is included in each system described herein to control various components and regulate functions, as described.

Generally, flow of propellant 86 within the Rankine cycle is driven by pump 50, which may be controlled directly by controlling the pump motor, or indirectly by placing a flow control valve downstream of the pump outlet (not shown). The flow of gaseous organic propellant through expander 30 may also be controlled via by-passing flow around the expander, regulating generation of secondary power. Propellant exiting the expander 30 may be passed through a recuperator 70 prior to circulation to the condenser 40 (for example, see FIGS. 4, 9, 11, 12, and 13).

The recuperator 70 (when present) reabsorbs thermal energy not dissipated at the expander 30, and simultaneously pre-heats the cooled propellant discharged from the pump 50 prior to heat transfer at the first heat exchanger 20. The recuperator thereby improves efficiency of the system, increasing secondary power generation.

Suitable organic propellants for use within Rankine cycle systems are known in the art, and generally include branched, substituted, or aromatic hydrocarbons, and organic halides. Suitable propellants may include refrigerants, CFCs, and hydrocarbons (propanes, butanes, or pentanes). Preferably, the propellant is butane, pentane, isobutane, R-134, or R-245fa.

Secondary Power

Secondary power is produced by the expander as mechanical shaft power, which may be converted to electricity or used to drive other equipment such as pumps or compressors. Secondary electric power may be used to power other site equipment, may feed into a motor control centre to be used on site, or may directly supplement primary power generated, for example by powering an electric motor coupled to a boost compressor, a cooling fan, or a pump. The ability to control and independently power various engine, compressor and ORC system components will improve energy efficiency of the system, as parasitic loads may be set to use power only when necessary. Further, when these system components are sources of parasitic load of the reciprocating engine, natural gas compressor, or within the balance of the ORC system, decoupling these loads from their current power source and instead using secondary power (generated using waste heat) will increase the amount of capacity available by the reciprocating engine to produce primary power and thus improve overall efficiency of the reciprocating engine. This additional engine capacity may be used to generate more primary power or reduce fuel consumption. Notably, the reduced load on the reciprocating engine will reduce engine reject heat, thereby reducing the amount of gross secondary power generated. The parasitic loads will adjust accordingly until a new equilibrium is reached.

Parasitic Loads

In a typical ORC system for collection of waste heat from an engine, net secondary power is the result of gross secondary power, less the system parasitic loads (for example, the condenser fan(s), propellant pump, thermal fluid circulating pump and jacket water pump (if present)). That is, the power required to blow adequate ambient air across propellant condenser conduits when the condenser is an air-cooled condenser, or pump operation to drive liquid-cooled condensers (which use cooling water to condense the propellant), detract from the gross secondary power generated by the ORC.

In the system shown in FIG. 1, fans 72 on the air-cooled condensers 40 are controlled by controller 100 to establish the level of cooling (sub-cool if necessary) that is required in the propellant. When ORC secondary power is used to power an electric motor driving the fan 83 on the reciprocating engine radiator 81, that motor can also be controlled by the control system 100 on an as needs basis. Further, should the reciprocating engine 10 be coupled to a natural gas compressor 68, electric power from the ORC may be used to power the motor driving the fan 77 on the aerial cooler, which can also be controlled by the control system 100 on an as needs basis to prevent the compressed gas from freezing in cold ambient conditions. Fan(s) on the condensers 40, radiator 81 and aerial cooler fan 77 (shown in FIG. 11) can be similarly controlled and/or combined (simultaneously cooling any combination of engine jacket water, engine auxiliary cooling fluid, compressed natural gas, compressor lubricating fluid) to reduce the parasitic loads on the reciprocating engine and the ORC system.

Typically, the aerial cooler fan 77 would be driven by the output shaft of the reciprocating engine 10 via direct shaft and pulley combination from the reciprocating engine. Decoupling this fan from the reciprocating engine and using a controlled electric motor powered by the secondary power output from the ORC, improves the overall system efficiency. It is estimated that this change alone will reduce the power requirement of the reciprocating engine by 6%, thereby reducing fuel consumption by approximately 6%.

Similarly, the engine radiator 81 is cooled by a fan 83 that is typically powered by a rotating shaft extending from the engine. As the fan operation would therefore be coupled to the engine, the fan would run constantly during engine operation, even under cool ambient conditions or other conditions not requiring active cooling of radiator fluid. Decoupling engine parasitic loads from the reciprocating engine power, and independent control of each system parasitic load will maximize energy efficiency. The controlled use of secondary power, generated by the expander, to power parasitic loads will control the parasitic loads of the reciprocating engine and natural gas compressor, and thus provide greater overall system energy efficiency. Computer modelling indicates that during controlled system operation in accordance with the present disclosure, secondary power generated solely by reject heat collected from the engine jacket fluid is suitable to provide power to the parasitic loads required to run an ORC system on the jacket water reject heat. That is, the heat collected from the engine jacket water, in the appropriate ambient air temperatures, can provide enough secondary power to drive all ORC parasitic loads (e.g. propellant circulating pump, jacket water booster pump (if required), condenser fans and aerial cooler fan) that may be required.

Supplementary Cooling Capacity

With reference to FIG. 1, an ORC system is shown in which heat from the reciprocating engine 10 jacket fluid 11 is collected at a first heat exchanger 20, and heat from engine exhaust 12 is collected within a thermal fluid 14, and transferred to the propellant 86 at a second heat exchanger 60. Organic propellant is heated to evaporation at heat exchangers 20 and/or 60, and the evaporated propellant passes through expander 30, to generate secondary power. Spent propellant exiting the expander 30 flows through a recuperator (when present), a condenser, a surge tank, a pump and then is returned to collect further heat from the heat exchangers collecting waste heat from the reciprocating engine 10.

With reference to FIG. 2, condensation of propellant may be aided by the addition of a supplementary cooler 42 as needed. Cooler 42 permits heat exchange between spent propellant exiting the expander and engine cooling fluid 11 or 16 which has been isolated from the reciprocating engine by control valves. This engine cooling fluid may be cooled in the engine radiator (see below) as required through appropriate operation of fan 83 (or fan 77 if the radiator has been stacked in an aerial cooler). The control will be through altering air flow across the radiator 81, speed of pump 87 and opening/closing of valves 80, 82, 84 and 85. Secondary power may be used to drive the circulating fluid pump 87, condenser fans 72, and radiator fan 83 (or aerial cooler fan 77, if applicable). The cooler 42 may be placed at any suitable location within the ORC system. For example, as shown in FIG. 2, the cooler may be used to transfer propellant heat (to the isolated engine cooling fluid which may be from either jacket water cooling system 11 or the auxiliary cooling fluid system 16, with heat then dumped to atmosphere through the radiators 81 or 64 respectively) at any location between the expander and condenser. When the ORC system includes a recuperator, the cooler 42 may be placed between the recuperator and condenser or between the expander and recuperator.

With reference again to FIG. 1, the radiator (not shown) associated with the reciprocating engine is not required for jacket water cooling during normal operation of the ORC, as waste heat collected by the engine jacket water 11 is instead transferred to propellant at the first heat exchanger 20, thereby also cooling the jacket water 11 sufficiently for safe return to the engine 10. Accordingly, the engine radiator 81 may be under-utilized, except when the ORC system is not capable of taking all of the jacket water reject heat, and/or during a shutdown of the ORC system when propellant flow is not available to cool the jacket water. As seen in FIG. 2, the radiator 81 remains present adjacent the engine, but may be isolated from the engine jacket 11 loop by opening or closing valves 80, 82, 84 and 85. Therefore, under most operating conditions, the radiator would be available to provide cooling of jacket fluid 11 as necessary, for example as cooling fluid circulating to and from cooler 42. This additional cooling capacity logic may also be applied to the auxiliary cooling fluid system 16 of the reciprocating engine.

Figure 9:
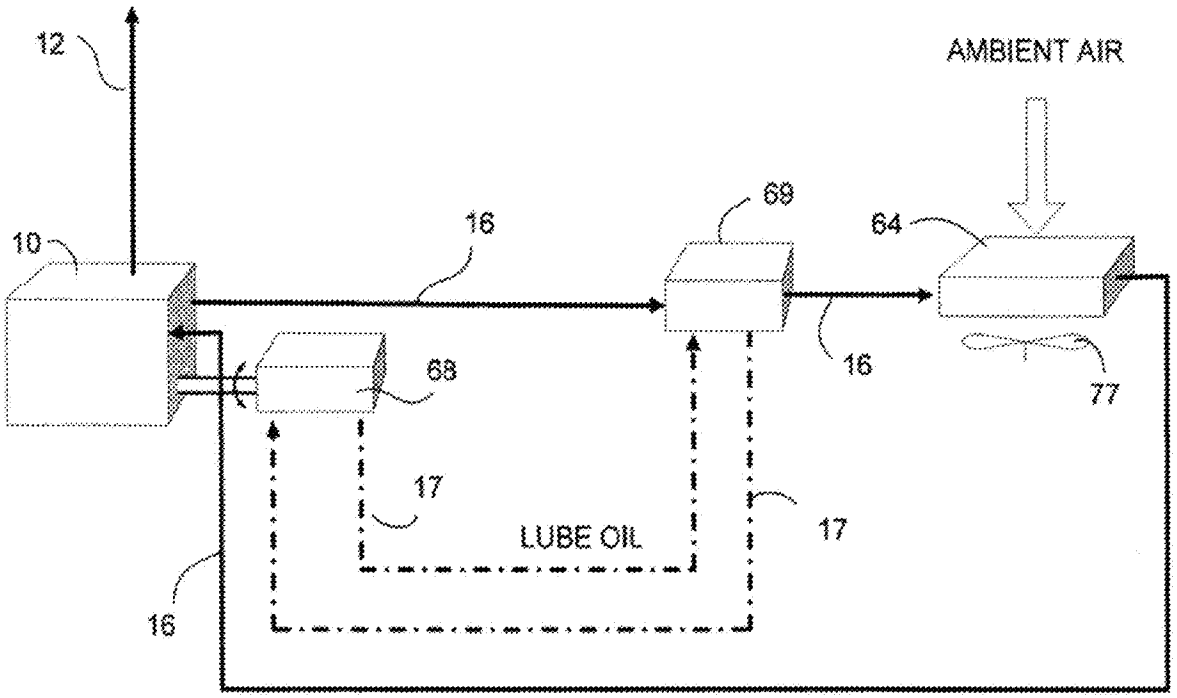
FIG. 9 is a schematic diagram of an ORC system coupled to a reciprocating engine and natural gas compressor, in which waste heat from the lubricating oil of a natural gas compressor is transferred indirectly to ORC propellant.
Figure 12:
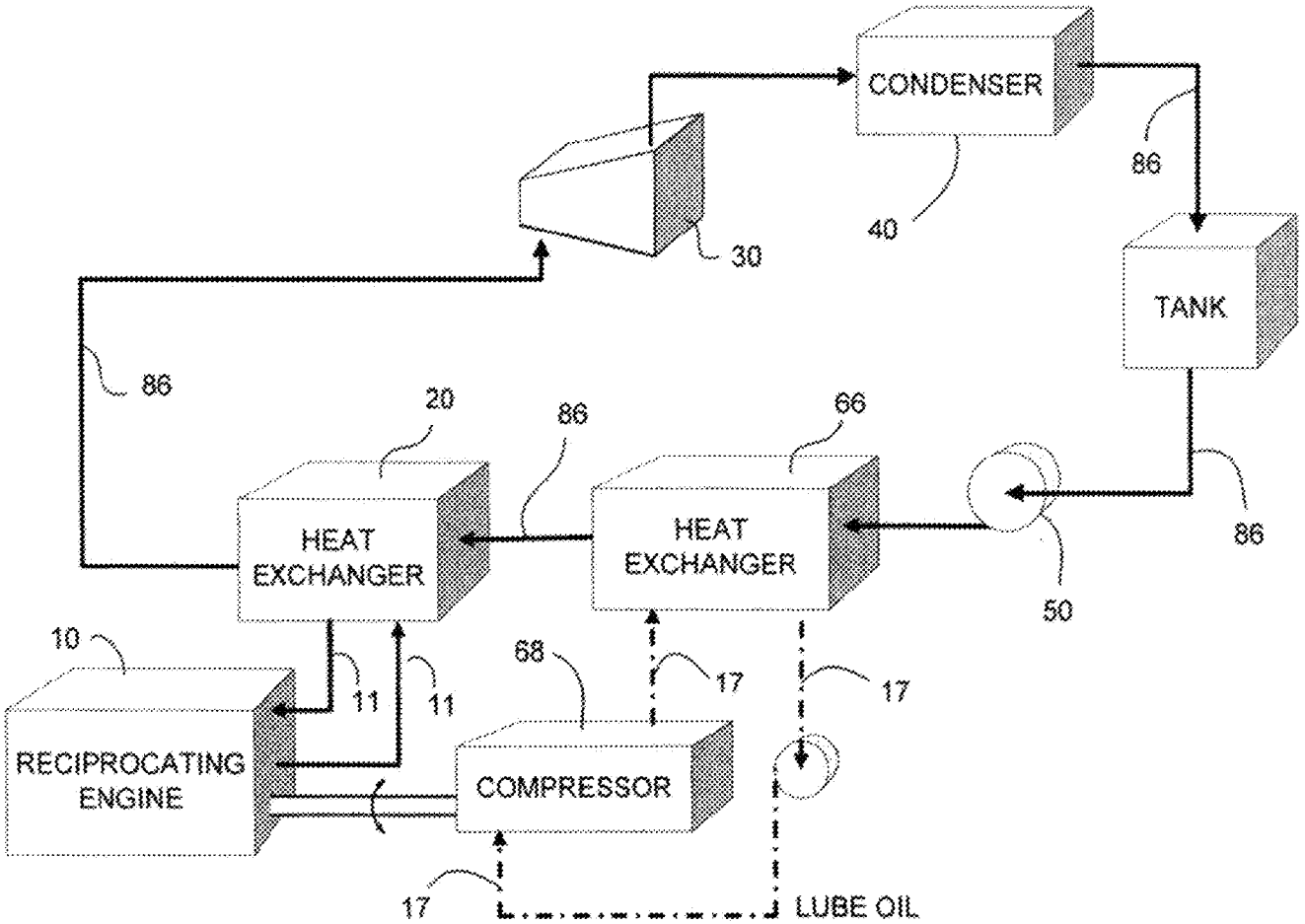
FIG. 12 is a schematic diagram of an ORC system for recovering waste heat from a reciprocating engine and natural gas compressor, in which waste heat from the lubrication oil of the natural gas compressor is transferred directly to the ORC propellant.

This radiator-based additional cooling capacity may further be combined with condenser cooling capacity by coupling or sharing of fans. That is, co-location of the condenser with the radiator, as shown in FIGS. 9 and 12, may allow simultaneous air cooling with reduced parasitic load. Further, co-location of the condenser 40, engines auxiliary cooling fluid system radiator 64 and the engine jacket water radiator 81, will permit sharing of fan capacity, blowing ambient air across multiple cooling lines (of condenser 40, and/or radiator 64 and/or radiator 81) simultaneously with fan 72. Further still, co-location of the condenser 40, radiator 64, radiator 81 and natural gas cooling conduits 89 (not shown) will permit sharing of fan capacity, blowing ambient air across multiple fin-tube sets, simultaneously. When these fans are driven by secondary power rather than as a direct load on the engine, further efficiency is realized.

Figure 3:
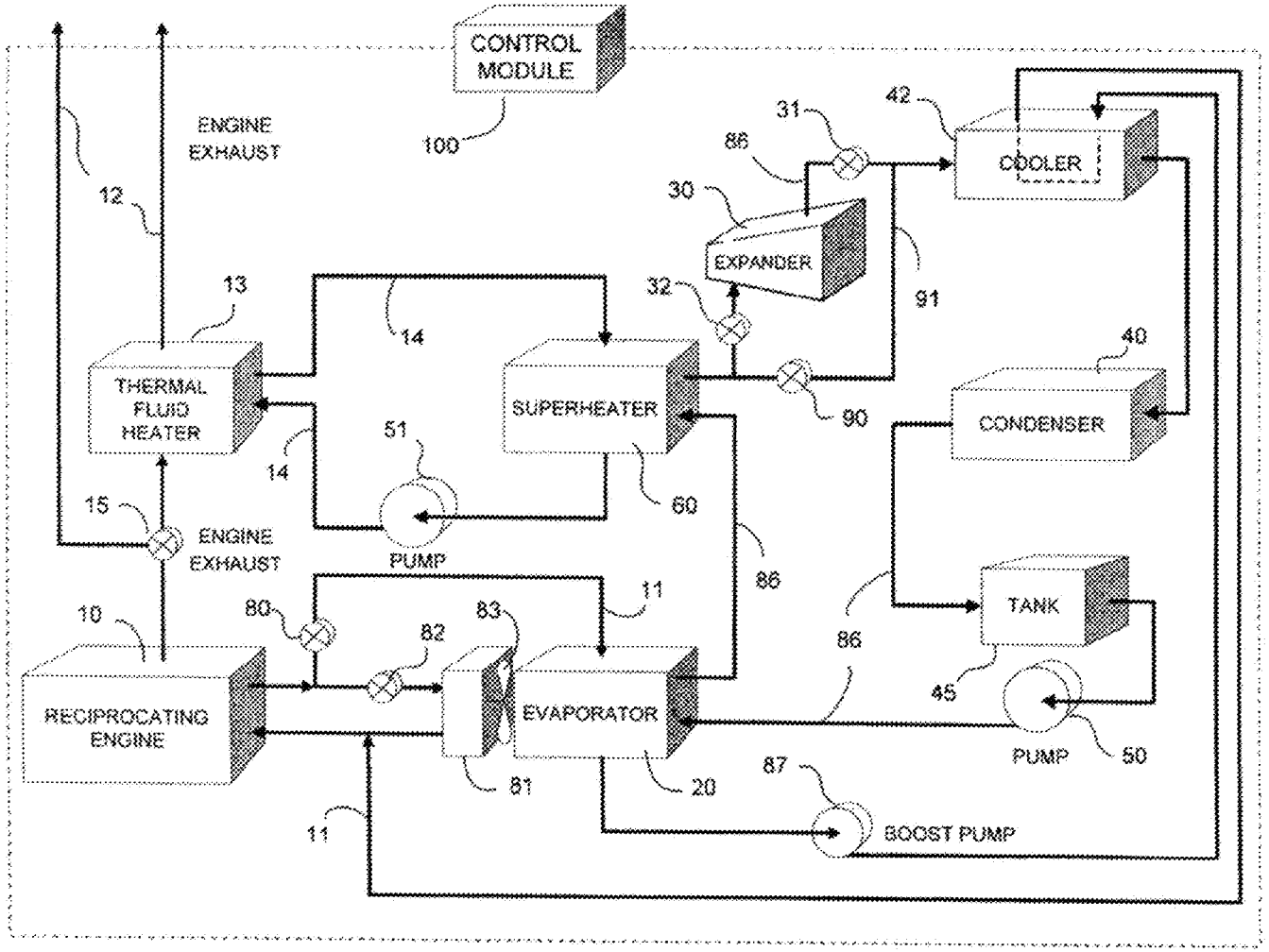
FIG. 3 is a schematic diagram of an ORC system coupled to a reciprocating engine, the ORC system including a supplementary cooler containing engine cooling fluid.

With reference now to FIG. 3, heat is transferred from spent propellant 86 exiting the expander 30, to the engine jacket fluid 11 (and/or to the engine auxiliary cooling fluid system 16, not shown in FIG. 3) flowing through supplementary cooler 42. The heated jacket fluid 11 may be appropriately circulated through the engine housing, or the engine auxiliary cooling fluid system. Accordingly, the engines jacket fluid or engine auxiliary cooling fluid system can initially be overcooled (for example, at the first heat exchanger 20) to a greater degree than that recommended by the engine manufacturer. The overcooled fluid is then reheated to appropriate temperature by passage through the cooler 42, by transfer of thermal energy from the spent propellant. The heat exchangers 20 and 42 are to be designed to provide sufficient heat duty/exchange such that the jacket fluid/auxiliary cooling fluid returning to the engine is consistent with the engine operating specifications.

With reference now to FIG. 4, condensation of propellant (or other liquid-cooling functions) may be supplemented or wholly provided by circulation of a cooling fluid to and from an underground location, where temperature is relatively constant throughout the year. Unlike air-cooled condensing in which significant temperature swings between seasons causes corresponding operational variations in equipment utilization from summer to winter seasons, ground source heat transfer is much more stable, as seasonal variations generally cease below approximately seven meters (thermal inertia) and therefore the equipment utilization will be more consistent than with an air cooled system. The desired temperature of the cooling fluid and geographic location will determine the length of condensing tubing required, and the depth to which fluid must be circulated prior to return to the condenser/heat exchanger. Accordingly, this method will be most practical in climates where ground temperatures are cool and wet and where land conditions are favorable to excavation for installation of fluid lines to appropriate depth. For example this cooling method may be suitable in Northern locations below the frost line where appropriate subsurface temperatures of 4 degrees Celsius to 12 degrees Celsius may be achieved at depths of approximately 2 to 6 meters. These temperatures and depths will vary with the geologic conditions of sub-surface conditions and vary with changing surface conditions depending on global location. In appropriate conditions, the operational energy required to condense in this manner is limited to the energy required to operate the circulation pump driving the subsurface circulation of cooling fluid. Geo heat exchange is more energy efficient than any other type of heat exchange as the parasitic load required to circulate the cooling fluid is significantly (3 to 5 times) less than the amount of thermal energy transferred, resulting in net thermal efficiencies greater than 100% (combustion is always below 100%), as high as 200% depending on the conditions. Accordingly, in favorable conditions, this ground source condensing/cooling will minimize parasitic load to the system by reducing or eliminating the need for cooling fans, thereby increasing the ORC system energy output.

Typically, a water/glycol mixture would be used as the heat transfer medium in the ground source condenser piping 99 and exchanged with the propellant at a heat exchanger 93. The water/glycol mixture would be pumped by pump 94 through the sub-surface tubing 99 to exchange heat with the relatively stable ground temperature. This relatively stable temperature would lend some predictability to the system. That is, with a stable ambient temperature (ground temperature), the power output curve when comparing ground source condensing to air cooled condensing would be flatter when plotting power versus ambient temperature such that the system components could be sized to appropriate capacity and better utilized throughout the year. By contrast, with air cooled condensing, much of the component capacity is under-utilized in cold weather due to limited requirement for cooling capacity and run at maximum capacity in warm weather.

As with any heat exchanger, if sufficient surface area is provided for consistent heat exchange, the only parasitic load associated with this heat sink would be the fluid circulating pump 94.

The water table will also impact heat exchange. Should the ground source condenser pipes be submerged below the level of the water table, the moisture within the soil will facilitate this heat exchange.

Increasing the recovery of additional energy from the reciprocating engine/compressor combination or increasing the cooling capacity of the system directly correlates with the ability to produce more net secondary power when the parasitic loads of the system are controlled independently of reciprocating engine and/or natural gas compressor operation. That is, if parasitic load on the reciprocating engine is reduced, the engine will not produce as much waste thermal energy, which will reduce waste heat collected by the ORC system, with reductions in the overall ORC output. Accordingly, adding further cooling capacity to the system without adding parasitic load directly to the engine will increase available secondary power.

With reference now to FIG. 5, an excess of heat is transferred from the jacket fluid to the propellant. That is, in this example, the jacket fluid is cooled beyond the engine manufacturer's specification to provide supplementary heat to the propellant, and then the jacket fluid is subsequently reheated to appropriate temperature for return to the engine by thermal energy collected within the engine auxiliary cooling fluid at heat exchanger 47. The jacket fluid can also be reheated by the other heat sources available such as the engine exhaust, or the compressor lubricating oil or gas conduits. Other modifications may also be made to the ORC portion of the system, as described herein.

Figure 6:
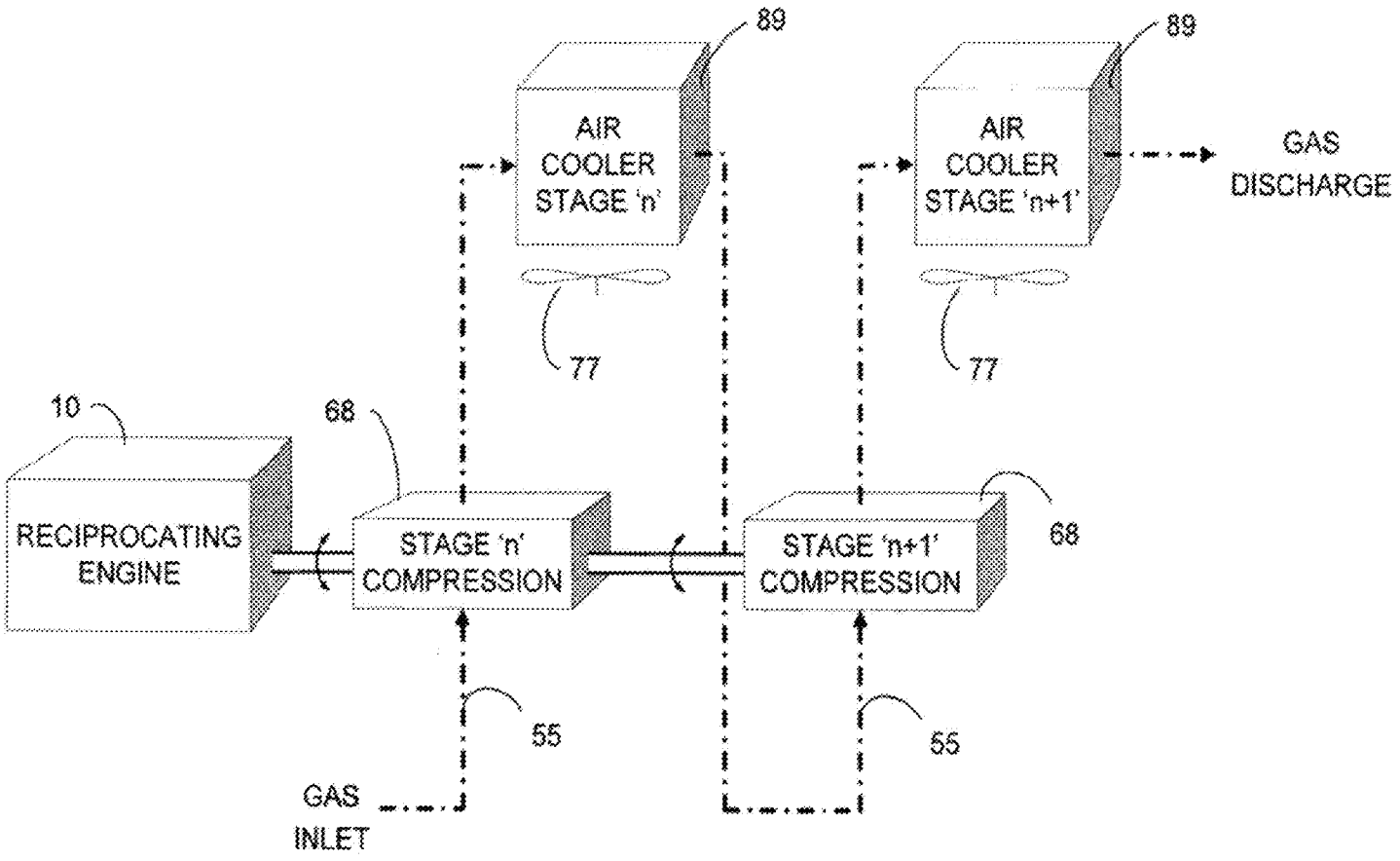
FIG. 6 is a schematic diagram of a prior art system for dissipating heat during natural gas compression.

FIG. 6 demonstrates how the thermal energy in compressed natural gas is typically dissipated. FIG. 7 demonstrates generally how this thermal energy might be harnessed in an ORC system.

FIG. 8 shows how a natural gas compressor package (reciprocating engine 10 and compressor 68) typically dissipates excess heat energy from the compressors lubricating oil 17 to atmosphere through heat exchanger 69 (a lube oil to engine cooling fluid heat exchanger) transfer from the lubricating oil 17 to either the engines auxiliary cooling fluid system 16 (or the engines jacket water 11) which then has ambient air blown across a radiator 64 (or 81 if jacket water) with fan 77 located on the aerial cooler.

FIG. 9 shows how the lube oil energy can be transferred to either the engines auxiliary cooling fluid system 16 (or to the engines jacket water system 11, not shown) through heat exchanger 69, where that cooling fluid with the additional thermal energy is then circulated to heat exchanger 20, thereby increasing the amount of thermal energy delivered to the propellant.

FIGS. 10 through 13 shows various configurations of how the thermal energy from the lubricating oil can be directly transferred via heat exchanger 66 to the propellant. Heat exchanger 66 can be located in various locations of the ORC system. Also shown is the various configurations of condenser 40 configurations, and aerial cooler configurations.

Safety Precautions

With respect to the collection of thermal energy from engine exhaust, thermal energy is transferred from the engines exhaust 12 to a thermal fluid 14 at heat exchanger 13, which then transfers the thermal energy to the propellant 86 at heat exchanger 60. Use of thermal fluid in this loop is preferable due to its stability even in the presence of high temperatures and sparks that may be present within the engine exhaust system. That is, if thermal fluid were to leak into the exhaust piping, it would likely burn-off within the exhaust stack (at worst, causing a fire within the stack). By contrast, a propellant leak within the exhaust piping may cause a fire or even an explosion, as exhaust gases may reach temperatures in excess of the propellant flash temperature. Suitable thermal fluids for use within the thermal fluid loop are typically mineral oils or synthetic oils (for higher temperature applications). These oils are generally formulated from alkaline organic or inorganic compounds.

Further, the thermal fluid loop allows the ORC system to be located a reasonable distance from the reciprocating engine, as thermal fluid may easily be pumped through a piping system (insulated pipes in cold climates) with little risk if energy losses are experienced, compared to energy loss from propellant over the same distance could cause the propellant to condense before reaching the expander 30. That is, using propellant within such pipes would risk a phase change in the propellant over the distance. Accordingly, the use of thermal oil to collect thermal energy from engine exhaust allows site space constraints (and potentially hazardous area classification inconsistencies) to be overcome. Accordingly, the reciprocating engine 10 can be housed separately from the ORC system, as there is no need to house the ORC components (heat exchangers, pumps, tanks, expander, etc.) within the reciprocating engine building. Separation of these components within different classification areas (hazardous area classification versus non-hazardous areas) or buildings provides further opportunities to improve efficiency, for example through use of propellant and equipment that is available at lower cost.

Gas Compression

The above improvements are particularly notable when the reciprocating engine primary power is used to drive natural gas compression, due to the above-described ability to physically separate components and for additional reject heat that can be utilized by the ORC system. For example, with natural gas compressors operating on a continuous basis, retrofitting an ORC system to the natural gas compressor package would require physical separation between the two systems due to the hazardous area classification of compressed explosive hydrocarbons would require the ORC system controller 100 and electric generator to be located at a safe distance (as per the hazardous area classification requirements) away from any piping. Further, it is typical that an existing compressor skid (some with a building surrounding them) would not physically accommodate a reciprocating engine and an ORC system.

In addition to waste heat from the reciprocating engine, thermal energy may be recovered from two sources of a natural gas compressor 68. As shown in FIG. 7, the first source is the temperature rise of the natural gas after each stage of gas compression, which can be used to directly (or indirectly) heat propellant within the ORC system. As shown in FIG. 10 to FIG. 13, the second source is the temperature rise of the lubricating oil of the natural gas compressor that can be used to heat propellant directly or indirectly within the ORC system.

The compressor lubricating oil is normally cooled using reciprocating engine jacket water 11 or auxiliary cooling fluid system 16 (see FIG. 8) which is then cooled in a radiator with a fan blowing air across it. The engine auxiliary cooling fluid system is typically used to cool engine intake air after the air has been compressed by the turbo charger(s). In the present system, as shown in FIG. 9 through to FIG. 13, thermal energy from the compressor lubricating oil may be collected directly or indirectly within the propellant 86.

With reference to FIG. 9, thermal energy from the compressor lubricating oil 17 is transferred to the engine auxiliary cooling fluid system fluid 16 (or jacket fluid 11) at heat exchanger 69, increasing the thermal energy of the transfer fluid. The lubricating oil 17 then returns to the compressor, and the heated auxiliary cooling fluid is directed to heat exchanger 20 where thermal energy is transferred to propellant.

In another embodiment, as shown in FIG. 5, the jacket fluid 11 may transfer supplementary heat to propellant (overcooling the jacket fluid) in heat exchanger 20. The amount of supplementary heat (i.e. amount of overcooling) can be matched to the expected reject thermal energy from the engine auxiliary cooling fluid system. That is, additional heat (beyond the engine manufacturers recommended heat rejection) can be extracted from the jacket fluid and provided to propellant in the ORC system (at heat exchanger 20), provided that an appropriate amount of heat is available from another source (for example the auxiliary cooling fluid) to reheat the jacket fluid at the engine after-cooler or heat exchanger 47. Appropriate sizing of the heat exchangers 20 and 47 will provide the appropriate heat balance of the system. In order to allow the reciprocating engine to operate with or without the ORC system operating, the engine auxiliary cooling fluid system may be interfaced with a heat exchanger 47 and appropriate valving to the jacket water's return line to the engine. That way, if the ORC is not operational, the engine can continue to send the jacket water 11 and the auxiliary cooling fluid system 16 to their respective radiators.

Figure 10:
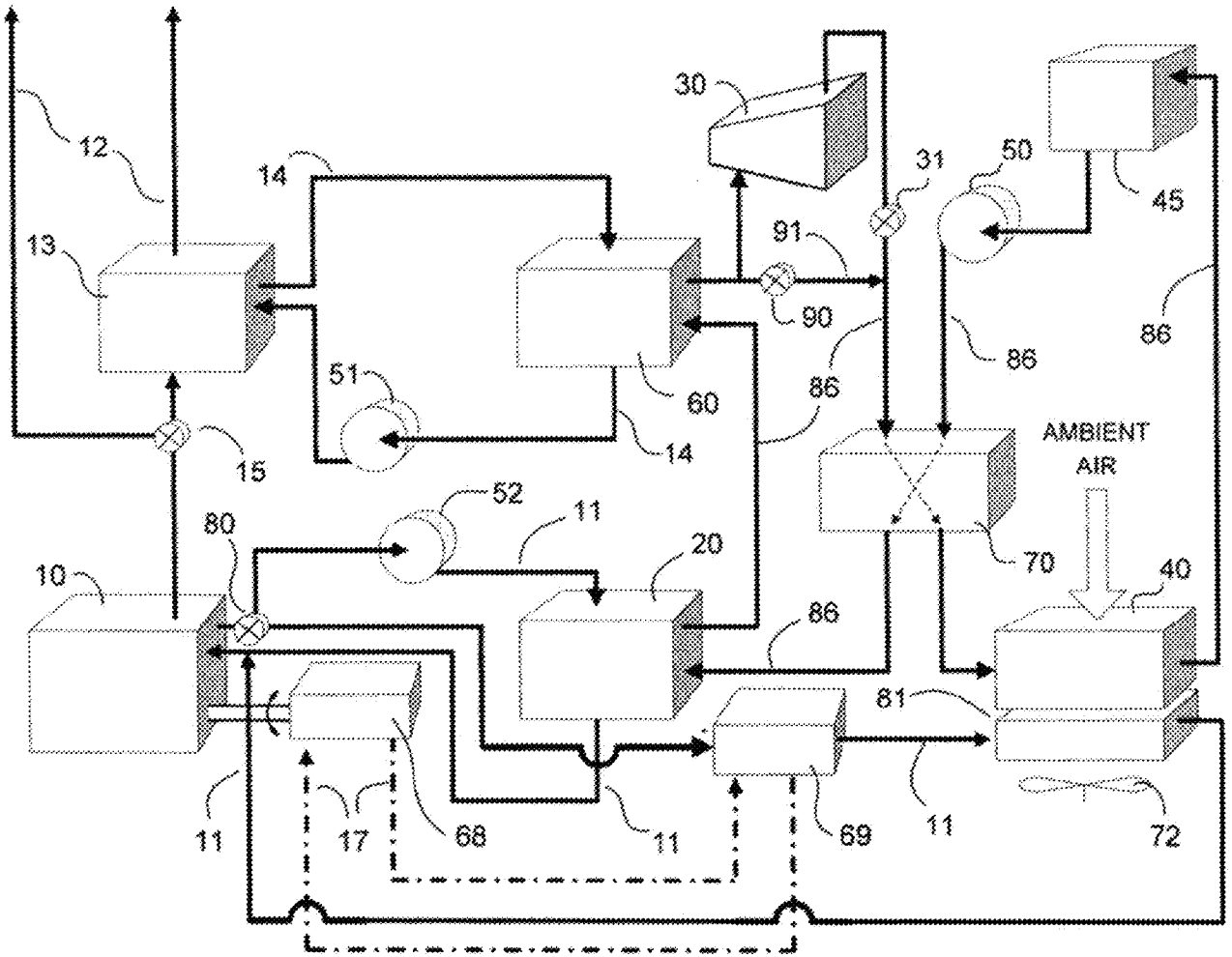
FIG. 10 is a schematic diagram of an ORC system for recovering waste heat from a reciprocating engine and natural gas compressor, in which waste heat from the lubrication oil of the natural gas compressor is transferred directly to the ORC propellant.
Figure 11:
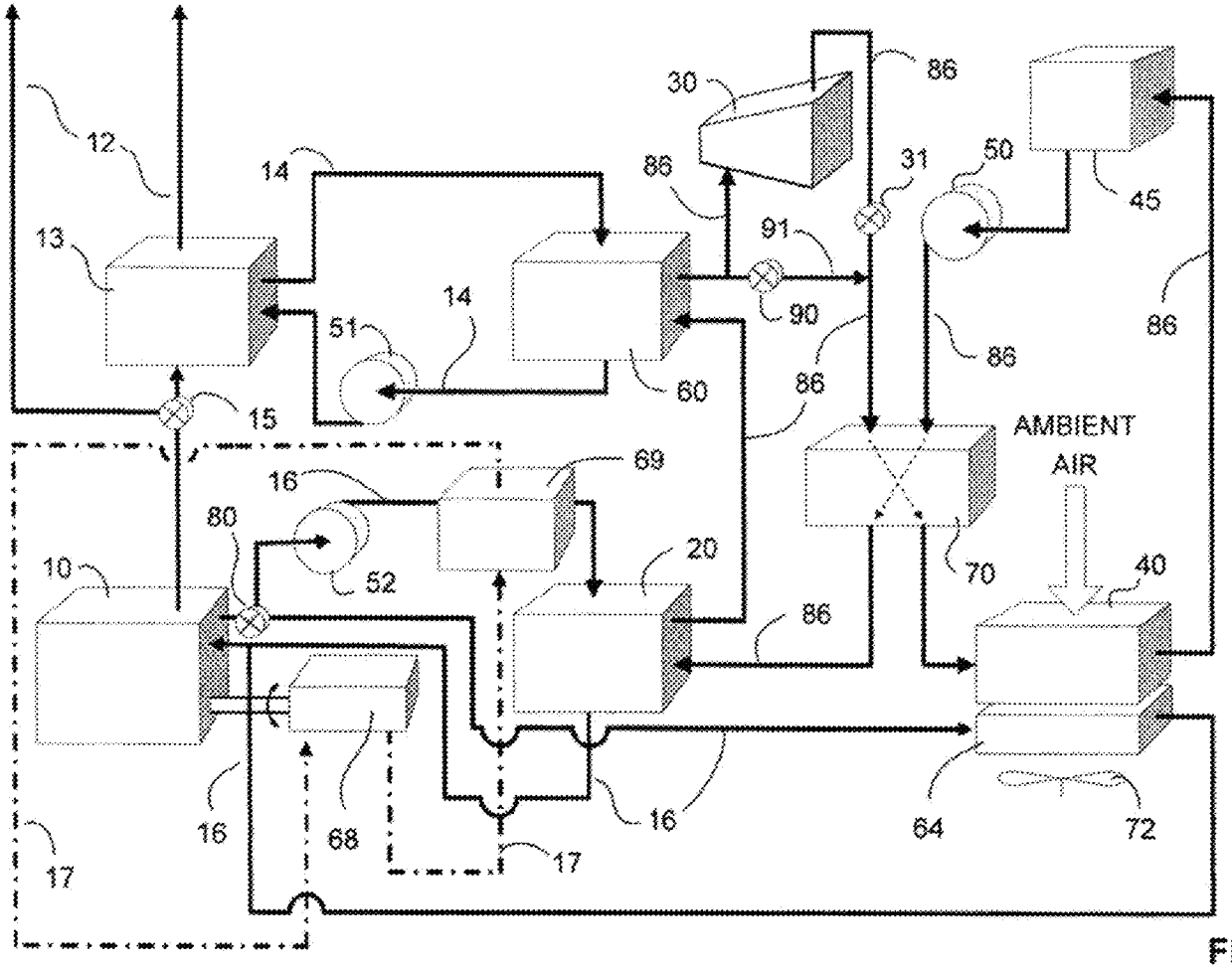
FIG. 11 is a schematic diagram of an ORC system for recovering waste heat from a reciprocating engine and natural gas compressor, in which waste heat from the lubrication oil of the natural gas compressor is transferred directly to the ORC propellant.

With reference to FIG. 10, thermal energy from the compressor lubricating oil 17 is transferred directly to propellant 86 within the ORC system at supplementary heat exchanger 66, which may be placed at any suitable location within the ORC system. In the embodiment shown, cooled compressor lubricating oil 17 is returned to the compressor 68, and heated propellant is directed to either heat exchanger 20 or 60, depending where heat exchanger 66 is inserted into the ORC system. In FIGS. 11, 12 and 13, similar embodiments are shown, wherein thermal energy from the compressor lubricating oil is transferred directly to propellant in heat exchanger 66. The propellant is thereby preheated prior to exposure to the jacket fluid heat exchanger 20 and the thermal fluid heat exchanger 60.

Addition of Capacity to Existing Systems

It is expected that the teaching of the present description will provide significant advantages when used with existing reciprocating engine operations, in particular when coupled to a natural gas compressor. For example, an existing reciprocating engine used at a remote work site (for example, to power natural gas compression for pipeline transport) may be exploited to produce further site power by adding an ORC system, supplementary cooling capacity, and decoupling of engine, compressor and/or aerial cooler parasitic loads.

Collection of engine waste heat within exhaust based thermal fluid prior to transfer to organic propellant may overcome space constraints within close proximity to the reciprocating engine. Notably, the present teaching takes advantage of the existing engine radiator capacity to provide additional ORC cooling, and increasing heat recovery and conversion to useful power. Further, decoupling of the parasitic loads from the engine provides further efficiency in permitting careful control of the power supplied to these loads. Still further, the use of a thermal fluid loop to recover heat from the engine exhaust, and potentially other on-site heat sources, and transfer this heat to propellant enables heat to be transferred a reasonably significant distance from the engine, providing further opportunities for generation and use of secondary power. Moreover, the present system may be used to power parasitic loads of the reciprocating engine, power gas compressors, pumps, or electric generators, and the reciprocating engine ORC system may be further exploited by collection of reject heat from the compressed natural gas in compression conduits, and natural gas compressor lubricating oil for the purpose of generating additional secondary power. Such heat collection configurations and combinations are not contemplated in prior art systems.

A preferred system in accordance with the invention is intended for use with a reciprocating engine of the type commonly used to power electric generators or natural gas compressors, but is also useful with reciprocating engines that supply motive power to a vehicle, heavy equipment, or otherwise provide power to do useful work.

Generally, the reciprocating engine is used to provide power in stationary applications for generating electricity and for compressing natural gas for pipeline transport, and the secondary power source is produced in the form of mechanical shaft horsepower by the expander. This mechanical shaft power may be used to: 1) couple to a compressor to boost the inlet pressure of a primary compressor or to generically move gases; 2) couple to a pump to pump liquids; or 3) couple to an electric generator to produce electricity at grid-connected or remote sites where the electricity is then used to reverse feed the grid, supplement electrical demand on-site or power parasitic loads of the reciprocating engine or the ORC system. More specifically, the mechanical shaft power may be used to compress gas as a boost compressor for the primary compressor, to supplement the mechanical shaft power of the primary reciprocating engine, to pump liquids, or to generate electricity for any other local energy need. Thermal energy may be collected from one or more such engines and processes, with the system collecting thermal energy from all sources to provide further efficiencies in the operation of the Rankine cycle to produce secondary power.

System Operation

With reference to FIG. 1, flow of propellant through the Rankine cycle may be adjusted by a control module 100, which may include a motor controller (variable frequency drive—VFD) to vary the operation of the pump 50. Alternatively, the pump 50 may be a multi-stage centrifugal pump or a positive displacement pump that is adjustable directly by the control module 100. In the former case, should the control module receive data from the monitoring module that indicates the pump speed or torque should be increased/decreased, the control module sends a signal to the VFD that controls the electric motor at the propellant pump, thereby adjusting the flow rate or pressure of the propellant. Temperature and pressure of the propellant may therefore be monitored at one or more locations within the cycle to determine appropriate propellant flow and pressure for current operating conditions. A liquid level switch may be present on either the first heat exchanger 20 or on the second heat exchanger 60, which would be monitored by the monitoring system and provide feedback to the control module 100. When the level is low, the control module will increase the flow rate to send more propellant to the heat exchangers.

Notably, with respect to FIGS. 9 through 13, thermal energy sources may be evaluated based on the need to dissipate engine heat and where that heat could be utilized in the ORC system operation. That is, in any system, the engine jacket fluid or the engine auxiliary cooling fluid system will collect waste thermal energy from the engine that must be dissipated. Similarly, when a natural gas compression module is present, the compressor lubricating oil will also collect waste thermal energy, and further thermal energy from the gas compression conduits must be dissipated. Therefore, these heat sources should be prioritized for heat collection by their relative temperatures so that heat is being added to the propellant with each added waste heat source. Conversely, the engine exhaust need not be dissipated for proper system operation, as it may simply be vented to atmosphere. Therefore, heat collection from engine exhaust may be of a different priority, and utilized to increase the secondary power output of the ORC and to obtain suitable gaseous propellant temperature/pressure for delivery to the expander. In other words, once the ORC system is extracting heat from the sources that require heat dissipation, the exhaust can be trimmed to extract the amount of heat that the ORC system requires to function properly and most efficiently without affecting the reciprocating engines or compressors ability to operate.

In other words, the various sources of waste heat within a particular system configuration should be ordered/prioritized for heat transfer to propellant based on the ability to add heat to the propellant and thereby offset the parasitic load that would otherwise be required to dissipate that source of waste heat.

As an example, in cold weather conditions, propellant passing through an air-cooled condenser 40 may require only minimal forced air flow across the condenser, as the surface area of the condenser fin tubes permits a significant degree of thermal energy transfer with the cool ambient air. Similarly, in cold weather, less thermal energy may be available for collection from the engine 10 jacket fluid and compressor lubricating fluid (if present). Therefore, in cold temperatures, additional thermal energy may be collected from engine exhaust (and other lower priority heat sources) as needed, and the control module may additionally adjust the flow of propellant through the Rankine cycle by adjusting the speed of pump 50 to permit sufficient time to heat and cool propellant within the cycle. Supplementary cooling sources may also be adjusted or terminated.

The rotational speed of the expander 30 is controlled by operation of throttle valve 31 and or 32 (opening and closing to adjust propellant flow through the expander), regulated by a speed control module (not shown), which interfaces and communicates with controller 100. Cooling fans (if present) at the condenser may also be subject to the control module 100 such that fans are slowed, sped-up, or shut-down, depending on the cooling requirements, and the outside ambient temperature.

Further, the control module 100 may control/regulate exhaust bypass valves 15 and/or valve 80 and 82 to divert engine jacket water thermal energy to/from the organic Rankine cycle system. Propellant valve 90, in combination with propellant valve 31 and/or 32 (if present) may divert propellant (in fluid state or gaseous state) around the expander 30 during start-up and shutdown of the Rankine cycle and/or engine. When de-activated, bypass 15 diverts engine exhaust gases to atmosphere rather than to the heat exchanger 13 and diverter valve(s) 80 and 82 divert jacket water to the radiator 81. If required, thermal fluid circulating pump 51 (and jacket water pump 52 if utilized) may be sped-up or slowed-down by the control module 100 or shut down entirely. Similarly, as shown in FIG. 2, valves 80 and 82 may be activated by the control module 100 to fully or partially divert jacket fluid to the engine radiator 81 (which is preferably under utilized during operation of the Rankine cycle) rather than to the heat exchanger 20, and if required and/or present, jacket fluid booster pump 52 (shown in FIG. 1) may be simultaneously adjusted to meet the required flow. Similarly, the thermal fluid loop collecting engine exhaust 12 heat may be shut down by de-actuating valve 15 such that it diverts engine exhaust to atmosphere and if required, deactivating thermal fluid pump 51 so that propellant does not receive thermal energy from the thermal fluid loop, nor extract heat from heat exchanger 60, if the propellant is circulating in the ORC while the exhaust thermal fluid system is not functioning. Therefore, propellant within the Rankine cycle will adapt quickly to the thermal energy added or removed from the system.

As illustrated in FIG. 1, bypass line 91 directs propellant from heat exchanger 60 directly to the recuperator 70 (if present) and directly to the condenser 40 bypassing expander 30. Similarly, the recuperator 70 (not shown) may also be bypassed such that the propellant flows directly from the heat exchanger 20 or 60 to the condenser. Bypass of the expander 30 prevents propellant from entering expander 30. This may be desirable when the propellant is in liquid state, as entry of liquid propellant at high flow rates and pressures into the expander 30 may damage the internal components of the expander.

On system start-up, the expander may be bypassed by controlling valve 90 and 31 or 32 (if present) such that propellant is diverted to flow through bypass 91. It is generally desirable to maintain flow through the recuperator and prevent circulation of propellant through the expander 30 and of cooling fluid through cooler 42 (FIG. 2 and FIG. 3), to speed heating of the organic propellant within the Rankine cycle system. In certain embodiments, such as use of a screw expander, such bypass may not be necessary, as a screw expander has robust internal components and can handle limited liquids flow at low pressure. In a start-up situation, propellant pump 50 may not be activated by the control module 100 to operate until the heat at the heat exchangers 20 and/or 60 are sufficient to evaporate (and possibly superheat) any propellant that is in the ORC system between the pump and the expander at start-up. Either heat exchanger 20 or 60 may have a level switch installed to send a signal to the monitoring module, which then sends a signal to the control module, which then controls the speed of the propellant pump. When the propellant level in the heat exchanger with the level indicator is high, the propellant pump slows down and when the level is low, the propellant pump 50 speeds up to send more propellant to the heat exchangers. In a start-up situation where a by-pass around the expander does not exist, the level switch in the heat exchanger will read that the level is high and the pump will be inactive. Once the thermal energy from the engine heats up the propellant, the propellant will expand and flow towards the expander (because the propellant pump 50 is off and the valve 90 and/or 31 and/or 32 (if present) will be open). Once the level in the level controlled heat exchanger gets low, the propellant pump will start pumping fluid through the ORC such that the rate of pumping will match the rate of evaporation, thereby insuring that any propellant entering the expander is in a gaseous or semi-gaseous/saturated state. Therefore, on start-up, the only liquid propellant that shall pass through the expander will be the propellant that was between the evaporator 60 and the expander 30, which condensed to liquid when the system was not operating. That fluid will be slowly moved through the expander in liquid state at a low pressure and low speed, thereby minimizing the liquid exposure to the expander.

Rather than using level control on the heat exchangers to control pump operation, temperature and pressure sensors at the expander 30 and the condenser 40 can be used to determine the state of the propellant. Should the temperature and pressure of the propellant indicate that the propellant is near a phase change towards liquid state, the pump will be slowed down by the controller 100 to allow the heat exchangers 20 and/or 60 to deliver adequate heat to the system to evaporate propellant, such that only vapour reaches the expander.

If a secondary cooler 42 is present, for example as shown in FIG. 2 and FIG. 3, this configuration can be considered with or without a recuperator in the ORC system. When a recuperator is present, the cooler 42 would be located either between the recuperator and the condenser or the recuperator and the expander. As shown in FIG. 2, whether a recuperator is present or not, the cooler 42 would reduce the thermal energy reject load (duty) on the condenser 40 by offloading some of this heat dissipation in the engine radiator under operating conditions when the radiator is not being utilized.

If a secondary cooler 42 is present, whether a recuperator is present or not, the cooler may be used to reheat the engine jacket water 11 (or the engine auxiliary cooling fluid 16) such that the cooling fluid may be returned to the engine at the appropriate temperature.

When a recuperator is present, the cooler 42 could be located either between the recuperator and the expander or between the recuperator and the condenser. In either case, whether a recuperator is present or not, the cooler 42 would reheat the jacket water 11 leaving heat exchanger 20 before the jacket water 11 is returned to the reciprocating engine 10. In other words, heat exchanger 20 will extract more heat energy from the jacket water 11 than recommended by the engine manufacturer and then that jacket water 11 will be re-heated by the spent propellant off the back of the expander such that the reciprocating engine will not experience thermal shock and keep the engine thermostatic control valve flowing all of the jacket water to heat exchanger 20. To prevent surging in the ORC system, it is important to remove the appropriate amount of heat from the jacket water (per the manufacturer's specifications) so as to prevent jacket water flow from entering the engines internal re-circulation loop that maintains the jacket fluid at the appropriate temperature. In short, the system is designed to extract more energy than recommended from the jacket fluid in front of the expander in the ORC system and then add back some of that heat back to the jacket fluid before it returns to the engine, thereby utilizing the energy to extract secondary power but not affecting the reciprocating engines jacket cooling system. As an example, an engine manufacturer may suggest removing 10 degrees Fahrenheit between the engines discharge and the engine inlet. In the above example, the heat exchanger 20 could remove 25 degrees Fahrenheit from the engines jacket water discharge and then reheat that jacket water 15 degrees Fahrenheit by utilizing the heat in the spent propellant in cooler 42. The heat exchangers would have to be designed for the appropriate flow and temperature deltas to have a heat balance in the system so that flow of jacket water within the engine will not affect the engines thermostatic valve and the jacket flow will remain steady (no surging).

Likewise, if a geo-cooling loop is present as shown in FIG. 4, the cooling system consisting of the sub-surface geo heat exchanger 99, the circulating pump 94 and the propellant heat exchanger 93 may replace the air-cooled or liquid-cooled condenser operation, reducing the operating energy load by reducing the parasitic load for condensing propellant. The geo-cooling loop would have a heat transfer liquid (more than likely a water/glycol mixture) circulated between heat exchanger 93 and 99 by the use of circulating pump 94, all controlled by the control module 100.

Control Examples

Thermal energy is collected from the engine jacket fluid 11 and compressor lubricating oil 17 (if present), as these heat sources must be cooled appropriately for safe operation of the engine and compressor (if present). The rate of thermal energy exchange may be controlled to some extent by controlling pump 51, (pump 52 if present, using a motor controller—variable frequency drive), and using diverter valves 15 to vent exhaust gas or valve 80 and 82 to divert jacket water to the radiator 81, as necessary. For example, the amount of jacket water flow to the radiator may be proportioned to establish the amount of cooling required. When the ORC system is operational, diverter valves 80 and 82 direct jacket cooling fluid to the radiator 81 in conditions when thermal energy exchange with organic propellant is not desirable, or is not effective to sufficiently cool the cooling fluid of the reciprocating engine 10.

In the system depicted in FIG. 2, the control system 100 would utilize the capacity of the engine radiator by addition of the supplementary cooler 42. That is, when the engine radiator is not being utilized for engine cooling, its duty can be utilized to extract heat from the spent propellant of the ORC system, thereby reducing the load on the condenser 40. This would be accomplished by opening valve 80, opening valve 85, closing valves 82 and 84, turning on the circulating pump 87, turning on the cooling fan for the radiator and circulating the cooling fluid that is in the pipes and heat exchangers to extract heat from the spent propellant via the radiator. When the engine radiator 81 is required to cool engine jacket fluid 11, the supply of fluid from the supplementary cooler to the radiator will not be circulated through the cooling radiator and the engines jacket water will be pumped directly to the radiator. This would be accomplished by opening valves 82 and 84, while closing valves 80 and 85. When the radiator is not required to cool engine jacket water returning to the engine, radiator capacity may be leveraged by cooler 42 to provide additional propellant or compressor cooling capacity.

In the system depicted in FIG. 3, the control system 100 would utilize the capacity of cooler 42 to extract heat from the spent propellant to reheat the jacket water that was enroute from heat exchanger 20. This will be accomplished by control system 100 controlling booster pump 87 and valves 80 and 82, which will control the flow of jacket water between the radiator 81 and propellant heat exchanger 20. The duty of cooler 42 is sized with heat exchanger 20 and the amount of reject heat available from the engine so that regardless of the flow experienced, the energy transferred will be proportionate in both heat exchangers, which in turn will be calibrated to remove a pre-determined amount of thermal energy (duty) from the jacket water such that the jacket water temperature delta is commensurate with the amount of heat rejection the reciprocating engine manufacturer recommends.

In the system depicted in FIG. 5, the control system 100 would control valves 80, 82 on the jacket water 11 lines and valves 62 and 63 on the auxiliary cooling fluid system 16 lines such that the propellant at heat exchanger 20 could extract more heat energy from the jacket water than recommended by the engine manufacturer. To prevent the engines thermostatic valve from altering the jacket water flow to reject heat, the heat exchangers would be sized accordingly and controller 100 would sense the temperature of the jacket water before returning to the engine to determine the actions that are required of the jacket flow. That is, if enough heat has been extracted, then no flow will be directed to the radiators 81 and 64. Should it be determined that the jacket water is too warm to return to the engine, then flow will be directed to radiators 81 and 64 and the fan 83 speed will be adjusted accordingly.

The engine exhaust can be directed to the thermal fluid heater 13, or diverted past the thermal fluid heater (the organic Rankine cycle system) and vented to atmosphere. The diverter valve can be two valves working in unison, or a single integral valve that diverts flow from one path to the other. When the thermal energy from the engine exhaust 12 is required, diverter valve 15 will: 1) simultaneously start closing flow to atmosphere and start opening flow to the thermal oil heater 13 or 2) start opening flow to the thermal oil heater 13 and then start closing the flow to atmosphere, as regulated by the control module 100.

The exhaust thermal fluid cycle pump 51 driving the thermal fluid loop may also be controlled by the control module 100 using a motor controller as needed. In situations when the organic Rankine cycle is inoperative due to shutdown or failure of the ORC, the exhaust diverter valve 15 will divert the hot engine exhaust 12 to atmosphere and the thermal fluid circulating pump 51 turned off. Another option is to shut down the entire thermal fluid system to avoid supplying any residual thermal energy already present in the thermal fluid to heat exchanger 60. A thermal fluid storage tank (not shown) may be located in series with the heat exchangers or in parallel configuration.

Similarly, as shown in FIG. 4, with the ground source condensing application, heat exchangers 93 and 99, and pump 94 may be controlled to increase or decrease flow of a cooling medium which then will exchange heat with the propellant in heat exchanger 93 to increase or decrease cooling capacity of the propellant as desired.

As it is desirable that the propellant should enter and exit the expander in gaseous form, appropriate temperature and pressure sensors (and controls) are present at the expander 30 to allow the control module 100 to monitor and adjust the rate of thermal energy entering the ORC system, air flow across the condenser, propellant flow and back pressure by valves 31, 32 (if present) and 90 through the expander. Information from these sensors may also be used in the control of propellant flow within the Rankine cycle by adjusting pump 50 or the pressure across valves 31, 32 (if present) and 90. If necessary, valves 31, 32 (if present) and 90 may be activated to direct propellant through bypass loop 91 when secondary power generation is not necessary, or to divert liquid propellant from entering the expander 30. In addition to diverting the propellant within the ORC, engine thermal energy may be diverted to atmosphere, by directing jacket fluid to the radiator 81, and by diverting engine exhaust to atmosphere.

The expander 30 may be a screw expander. A screw expander typically has 65% to 85% efficiency, is easily controlled, is robust, and may be used with a variety of temperatures, pressures and flow rates. Moreover, although typical turbine blades may sustain damage upon contact with condensed/saturated droplets of propellant, the large diameter steel helical screws of a screw expander provide a robust mass and surface capable of withstanding temporary exposure to liquids. Therefore, use of a screw expander will improve the overall efficiency and integrity of the system.

The control module 100 for use in accordance with an embodiment of the invention includes a monitoring module that monitors the temperature and/or pressure of propellant within the system and the control module adjusts the parasitic loads of the system as needed to improve efficiency and maximize secondary power generation. Suitably, a temperature sensing device and/or a pressure sensing device are placed at the expander and/or condenser to enable monitoring of the physical state of the propellant at these locations. Preferably, such devices are placed at each of the expander 30 and condenser 40 to enable monitoring of the physical state of the propellant at both locations. The control module may adjust: the propellant pump 50 speed, fan speed at the condenser if air-cooled, condenser pump speed (if liquid-cooled), ground source condensing pump (if present), cooler 42 circulation pump (if present), diverter valve 15 at the exhaust bypass, speed of pump 51 of the thermal fluid pump, diverter valves 80, 82, 84 (if present) 85 (if present) and pump 87 (if present) at the jacket water bypass, or speed of pump 52 (if present) of the jacket fluid pump to ensure that propellant entering the expander is gaseous, and propellant exiting the condenser is liquid.

The control module 100 may be manual, but is preferably automated, including a processor for collecting and processing information sensed by the monitoring module, and for generating output signals to adjust flow of propellant through the system, activate valves, and adjust pump and fan speeds as necessary. These adjustments may be made through use of relays or through use of motor controllers and variable frequency drives associated with each component. The processor may further collect information regarding primary and secondary power output and may activate a tertiary power source when more power is required.

Notably, the amount of thermal energy collected from the reciprocating engine 10 may be adjusted by the control module by varying the flow of jacket water through the engine jacket to heat exchanger 20 by diverting it to the engine radiator 81. Similarly, the amount of thermal energy collected from the exhaust system 12 can be varied by regulating the exhaust diverter valve 15, such that the exhaust energy can be diverted directly to atmosphere or to the thermal fluid 14 through heat exchanger 13. Heat collected from a natural gas compressor would be controlled by altering the flow of the lubricating oil and/or the flow of the propellant. If it is the compressed natural gas that is the source of the waste heat, the flow of the natural gas will not be altered nor controlled by the controller 100, as the engine—the primary power source is used to compress gas and the intent of the waste recovery system is intended not to interfere with the primary power sources operations. The flow of propellant on the other side of the heat exchanger will affect the amount of energy that is extracted from the natural gas. In either case, the objective of recovering the waste heat from the compressed natural gas conduits is to reduce the load on the air cooled heat exchanger (known in the industry as an aerial-cooler).

On start-up, the control module 100 is programmed to add engine thermal energy to the system without circulating propellant 86 until the liquid propellant 86 in the engine-associated heat exchangers reaches a predetermined temperature and/or pressure. At this point, the propellant circulating pump 50 is started at slow speed to ensure that propellant 86 is sufficiently heated within the engine-associated heat exchanger 60 and/or heat exchanger 20 to evaporate the propellant prior to reaching the expander. In this manner, only a minimum amount of liquid propellant that condensed in the piping between the evaporator 60 and the expander 30 will pass through the expander 30 on start-up, eliminating the need for bypassing the expander on start-up. Thus, the Rankine cycle is quickly operational upon pump 50 start-up and thermal energy may be collected and used for secondary power generation in accordance with the invention.

With reference to FIGS. 9 through 13, the engine may be used to power a natural gas compressor. In these embodiments, further thermal energy may be recovered from the lubricating oil and/or one or more of the gas compression stages, as each stage of gas compression generates a significant amount of thermal energy that must be removed from the gas (before the gas enters the pipeline system) and from the lubricating oil. Typically, the engine jacket fluid is cooled in an air-cooled radiator 81 and the natural gas is air-cooled after each stage of compression in gas coolers 89. The gas coolers 89, when co-located together with the radiator 81, are referred to as an "aerial cooler" (an air-cooled fin-tube configuration including a common fan 77 that blows air across both sets of the fin-tubes), and engine exhaust is separately vented to atmosphere. Instead of simply dissipating this heat to atmosphere, the thermal energy generated from the exhaust, the jacket water, each stage of gas compression, and the lubricating oil of the natural gas compressor may be collected within heat exchangers 13, 20, 21, 22, 68 and 69 and used to heat organic propellant between the condenser and the expander. This recovered thermal energy will result in additional secondary power generation, which power may be used to further improve system efficiency. Moreover, the gas cooler 89 may be co-located with air-cooled condenser 40 and With radiator 81 to permit cooling by one set of fans 72 operated by the control module 100.

Typically, the natural gas compressor lubricating oil is cooled by heat exchange with either the engines jacket water or the engines auxiliary cooling fluid system (typically a water/glycol mixture), which is then pumped to the aerial cooler for liquid to air cooling. The heat in the lubricating oil that needs cooling can transfer the waste heat to the propellant either through direct interface through a heat exchanger or indirectly by interface with jacket fluid or auxiliary cooling fluid system (FIGS. 9 to 13). The intermediate fluid (jacket fluid, auxiliary cooling fluid) then transfers heat to propellant.

As the condenser fan(s) 72, the radiator cooling fan 83 and the aerial cooler fan 77 are a major parasitic load within the system, the control module is programmed to reduce fan speeds whenever possible, for example in cool weather or reduced engine output. This is accomplished by detecting fluid temperatures in the system and providing the fan(s) with an electric motor(s) with controller(s) (variable frequency drive), or by providing each fan with a multi-speed electric motor operated directly by the control module 100. In typical natural gas compression configurations, the associated aerial cooler fan 77 is often powered through a jack-shaft coupled to the reciprocating engine's crank shaft via a series of shafts and pullies, drawing power directly from the reciprocating engine (not shown). Similarly, a reciprocating engine coupled to a generator is typically associated with a belt-driven radiator fan 83. An opportunity exists to de-couple the aerial cooler fan 77 from the jack-shaft (not shown) and drive fan 77 directly with an electric motor (not shown), that is controlled by the control module 100, by feedback from the monitoring module which utilizes a motor controller (or as a controllable multi-speed fan) to control its speed. The power load of aerial cooler fan 77 is now being supplied by the secondary power source, thereby reducing the load on the primary engine. The reciprocating engine may therefore use less fuel to produce the same amount of net power, or conversely, may consume the same amount of fuel with more primary power output.

Ultimately, the control module 100 in conjunction with the monitoring module (not shown), controls recovery of thermal energy from the primary power reciprocating engine 10 and uses this thermal energy to create a secondary power source. The control module is programmed to maximize net horsepower by reducing parasitic loads of the ORC system or the reciprocating engine, when available, or to increase the amount of waste heat from the reciprocating engine 10 or compressor 68. For example, in some circumstances, more net horsepower may be produced by reducing parasitic loads within the system, while in other circumstances more net horsepower may be produced by maintaining or increasing parasitic loads and driving secondary power generation by recovering more waste heat. The monitoring module and control module 100 therefore work together to reallocate thermal energy from the compressor lubricating oil (via the auxiliary cooling fluid system, the jacket water system, or by direct interface with the propellant), the jacket water and the engine exhaust, determining the optimal parasitic loads on the ORC system in order to further maximize secondary power generation as necessary. In all embodiments, the reciprocating engine 10 operates at its required capacity to deliver the appropriate amount of primary power, and the inherent operational requirement for removal of engine thermal energy is achieved by some combination of: diversion of exhaust gases direct to atmosphere; cooling of the engine by its radiator fluid loop; collection of exhaust heat for use within the ORC system; collection of natural gas compressor reject heat (from the lubricating oil or the heat developed from gas compression) and collection of engine jacket radiant heat for use in the ORC system and collection/dissipation of auxiliary cooling fluid system energy for use in the ORC system.

The control module is programmed based on data that has been compiled by running simulation software designed to optimize power output. That is, various possible readings from the associated monitoring module (for example ambient air temperature or temperature/pressure of propellant) are initially compared to the optimized data results and corresponding adjustments are made to the ORC system to see if these alternations improve the net horsepower output of the system. The complete data set of such readings and corresponding optimized operating conditions are loaded into the control module and then adjusted by the control module 100 to enable the system to quickly settle into optimal operating condition in any situation. As the system gathers operating data and the system performance is compared to that of the simulated operation, adjustments to the programming of the control system may be made to get the best results through a closed loop system based on the iterations previously encountered.

When the system is generating secondary power as electricity, for example, the secondary power generated may be sent to a motor control centre or power hub, which also receives power from any other sources (the reciprocating engine coupled to a generator, the grid, tertiary power source, etc) and allocates power on demand. When the parasitic loads of the ORC system and other power loads is not satisfied by the primary and secondary power sources alone, the motor control centre may indicate to the demand module, which then corresponds with the control module 100, that the tertiary power to the site should be dispatched to start generating power.

In a specific example, the reciprocating engine may be used to compress natural gas, with secondary shaft power used to: 1) power a boost compressor that boosts the inlet gas pressure of the primary compressor 68, 2) power a pump that can be used to re-inject produced water, 3) power a generator, or 4) supplement the output of the primary source or its parasitic loads.

In certain situations, particularly in remote locations, a demand for power exists in operation of a work site. Notably, the demand may fluctuate from time to time. As such, a tertiary power source may also be available, such as a generator, stored power in a battery, solar power, wind, fuel cell, or grid power. This tertiary source of power may be operated as the main source of power on the site with the reciprocating engine and the secondary power utilized as additional power. In some cases, the power generated by the engine and secondary power source may not be sufficient to meet the needs of the job site and therefore an additional fuel based tertiary power source may be required to be dispatched so that the site demand can be met.

Accordingly, the control module 100 may also initiate alterations in performance which may require tertiary power. However, in certain embodiments, tertiary power should only be accessed when necessary to ensure an uninterrupted supply of power to the site. Usage of the tertiary power source will increase the operating cost of the site, however: 1) the overall cost of power will be reduced as power may be supplied by the thermal energy recovery system in place of fuel-fired generators; and 2) in many off-grid locations the total operating cost is less important than providing a reliable level of power at the site.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A system for collection and conversion of thermal energy to mechanical energy, the system comprising:

a reciprocating engine, configured to provide primary power and to provide thermal energy comprising engine exhaust and one or more non-exhaust sources of energy; and an Organic Rankine Cycle (ORC) comprising a propellant heat exchanger comprising an evaporator for collecting heat from one or more non-exhaust sources of thermal energy, a superheater heat exchanger for collecting heat directly or indirectly from the engine exhaust source of thermal energy, an expander and a condenser, wherein the ORC is operable to collect and use (i) at least a portion of the one or more non-exhaust sources of thermal energy to heat and evaporate an organic propellant in the propellant heat exchanger, and (ii) the evaporated organic propellant to superheat the evaporated organic propellant using exhaust heat of the superheater to drive the expander in generating secondary power, and wherein the ORC comprises a processor-based control module configured to control a flow of the organic propellant to the propellant heat exchanger to match the flow of the organic propellant to a rate of evaporation in the propellant heat exchanger to provide only vapor to drive the expander, and wherein the condenser is configured to condense spent propellant from the expander into liquid form for recirculation to the propellant heat exchanger.

2. The system of claim 1, wherein the processor-based control module is further configured to monitor and control at least a portion of the thermal energy collected from the reciprocating engine by the ORC to control heat transfer to the organic propellant for secondary power generation.

3. The system of claim 1, further comprising at least one supplementary heat exchanger, configured to transfer thermal energy from at least one of:

(i) engine exhaust, and (ii) engine lubricating oil, to cooling fluid of the reciprocating engine.

4. The system of claim 3, wherein the at least one supplementary heat exchanger is configured to transfer thermal energy to the cooling fluid before the cooling fluid interfaces with the ORC.

5. The system as in claim 3, further comprising an engine radiator, wherein at least a portion of the cooling fluid is circulated to the radiator to dissipate thermal energy transferred to the cooling fluid.

6. The system as in claim 5, wherein the reciprocating engine is configured to provide cooling fluid, and wherein the radiator is configured to circulate at least a portion of the cooling fluid.

7. The system as in claim 1, wherein thermal energy in the reciprocating engine cooling fluid is exchanged with the propellant heat exchanger to extract more thermal energy than is necessary from the cooling fluid to keep an engine thermostat in the reciprocating engine from modulating, and wherein the thermal energy from at least a portion of one of (i) engine lubricant, (ii) engine exhaust, and (iii) propellant, is used to reheat at least a portion of the cooling fluid prior to circulation back to the engine.

8. The system of claim 1, further comprising a cooler configured between the expander and the condenser, and configured to circulate cooling fluid to provide supplementary cooling to the organic propellant.

9. The system as in claim 8, wherein the reciprocating engine is configured to provide cooling fluid to the cooler, and wherein a supplementary heat exchanger is configured to circulate at least a portion of the cooling fluid.

10. The system as in claim 8, further comprising an engine radiator, wherein at least a portion of the cooling fluid from the cooler is circulated to the radiator to dissipate thermal energy transferred to the cooling fluid from the propellant at a supplementary heat exchanger.

11. The system as in claim 8, further comprising a ground source heat exchange conduit, wherein at least a portion of the cooling fluid from the cooler is circulated to the ground source heat exchange conduit to dissipate thermal energy transferred to the cooling fluid from the propellant at a supplementary heat exchanger.

12. The system as in claim 1, further comprising a cooling fan for cooling system components, said system components comprising at least one of (i) the condenser, (ii) a radiator and (iii) a cooler configured to circulate cooling fluid through the system to provide supplementary cooling capacity, and wherein two or more system components are co-located in proximity to the cooling fan so as to be simultaneously cooled by the fan using one of (i) power from the reciprocating engine, (ii) power from the secondary power and (iii) power from a power hub.

13. A system for collection and conversion of thermal energy to mechanical energy, the system comprising:

a reciprocating engine, configured to provide primary power and to provide thermal energy comprising engine exhaust and one or more non-exhaust engine sources of energy;

a natural gas compressor operable to compress natural gas within natural gas conduits, wherein the natural gas compressor is configured to provide a source of thermal energy;

an Organic Rankine Cycle (ORC) comprising a propellant heat exchanger, comprising an evaporator for collecting thermal energy from at least one of the natural gas compressor and the non-exhaust engine sources of energy, a superheater heat exchanger for collecting heat directly or indirectly from the engine exhaust source of thermal energy, an expander and a condenser, wherein the ORC is configured to collect and use at least one of (i) the one or more non-exhaust sources of thermal energy to heat and evaporate an organic propellant in the propellant heat exchanger, and (ii) the thermal energy from the natural gas compressor to heat and evaporate an organic propellant in the propellant heat exchanger, wherein the ORC is operable to superheat the evaporated organic propellant using exhaust heat of the superheater to drive the expander in generating secondary power, and wherein the ORC comprises a processor-based control module for controlling a flow of the organic propellant to the propellant heat exchanger to match the flow of the organic propellant to a rate of evaporation in the propellant heat exchanger to provide only vapor to drive the expander, and wherein the condenser is configured to condense spent propellant from the expander into liquid form for recirculation to the propellant heat exchanger.

14. The system of claim 13, wherein the processor-based control module is operable to monitor and control at least a portion of the thermal energy collected from the reciprocating engine or natural gas compressor by the ORC to control heat transfer of the organic propellant for secondary power generation.

15. The system of claim 13, further comprising at least one supplementary heat exchanger, configured to transfer thermal energy from at least one of:

(i) engine exhaust, (ii) engine lubricating oil, (iii) engine auxiliary cooler, (iv) compressor lubricating oil, and (v) compressed natural gas to cooling fluid of the reciprocating engine.

16. The system of claim 15, wherein the at least one supplementary heat exchanger is configured to transfer thermal energy to the cooling fluid before the cooling fluid interfaces with the ORC.

17. The system as in claim 15, further comprising an engine radiator, wherein at least a portion of the cooling fluid is circulated to the radiator to dissipate thermal energy transferred to the cooling fluid.

18. The system as in claim 17, wherein the reciprocating engine is configured to provide cooling fluid, and wherein the engine radiator is configured to circulate at least a portion of the cooling fluid.

19. The system as in claim 13, wherein thermal energy in the engine cooling fluid is exchanged with the propellant heat exchanger to extract more thermal energy than is necessary from the cooling fluid to keep an engine thermostat in the reciprocating engine from modulating, and wherein the thermal energy from at least a portion of one of (i) compressor lubricating oil from the natural gas compressor, (ii) compressed natural gas, (iii) engine lubricant, (iv) engine exhaust, and (v) propellant, is used to reheat at least a portion of the cooling fluid prior to circulation back to the engine.

20. The system of claim 13, further comprising a cooler configured between the expander and the condenser, and configured to circulate cooling fluid to provide supplementary cooling to the organic propellant.

21. The system as in claim 20, wherein the reciprocating engine is configured to provide cooling fluid to the cooler, and wherein the at least one supplementary heat exchanger is configured to circulate at least a portion of the cooling fluid.

22. The system as in claim 20, further comprising an engine radiator, wherein at least a portion of the cooling fluid from the cooler is circulated to the radiator to dissipate thermal energy transferred to the cooling fluid from the propellant at the at least one supplementary heat exchanger.

23. The system as in claim 20, further comprising a ground source heat exchange conduit, wherein at least a portion of the cooling fluid from the cooler is circulated to the ground source heat exchange conduit to dissipate thermal energy transferred to the cooling fluid from the propellant at the at least one supplementary heat exchanger.

24. The system as in claim 13, further comprising a cooling fan for cooling system components, said system components comprising at least one of (i) the condenser, (ii) a radiator (iii) a cooler configured to circulate cooling fluid through the system to provide supplementary cooling capacity, (iv) engine auxiliary cooler, (v) compressor lubricant cooler, and (vi) natural gas cooling conduits, and wherein two or more system components are co-located in proximity to the cooling fan so as to be simultaneously cooled by the fan using one of (i) power from the reciprocating engine, (ii) power from the secondary power, (iii) power from a power hub, and (iv) a tertiary power source.

25. A method for collecting and converting thermal energy in a system, the method comprising:

providing primary power and thermal energy via a reciprocating engine, the thermal energy comprising engine exhaust and one or more non-exhaust sources of energy;

collecting heat in an Organic Rankine Cycle (ORC) from one or more non-exhaust sources of thermal energy via a propellant heat exchanger comprising an evaporator;

collecting heat in the ORC directly or indirectly from the engine exhaust source of thermal energy via a superheater heat exchanger;

collecting, in the ORC, at least a portion of the one or more non-exhaust sources of thermal energy to heat and evaporate an organic propellant in the propellant heat exchanger;

superheating, via the superheater heat exchanger, the evaporated organic propellant using engine exhaust thermal energy to drive an expander in the ORC to generate secondary power;

controlling, via a processor-based control module, a flow of the organic propellant to the propellant heat exchanger to match the flow of the organic propellant to a rate of evaporation in the propellant heat exchanger to provide only vapor for driving the expander and condensing, via a condenser in the ORC, spent propellant from the expander into liquid form for recirculation to the propellant heat exchanger.

26. The method of claim 25, further comprising monitoring and controlling, via the processor-based control module, at least a portion of the thermal energy collected from the reciprocating engine by the ORC to control heat transfer to the organic propellant for secondary power generation.

27. The method of claim 25, further comprising transferring, via at least one supplementary heat exchanger, thermal energy from at least one of:

(i) engine exhaust, and (ii) engine lubricating oil, to cooling fluid of the reciprocating engine.

28. The method of claim 27, further comprising transferring thermal energy, via the at least one supplementary heat exchanger, to the cooling fluid before the cooling fluid interfaces with the ORC.

29. The method of claim 27, further comprising circulating, via an engine radiator, at least a portion of the cooling fluid to the radiator to dissipate thermal energy transferred to the cooling fluid.

30. The method of claim 29, further comprising providing cooling fluid via the reciprocating engine and circulating at least a portion of the cooling fluid via the radiator.

31. The method of claim 25, further comprising exchanging thermal energy in the reciprocating engine cooling fluid with the propellant heat exchanger to extract more thermal energy than is necessary from the cooling fluid to keep an engine thermostat in the reciprocating engine from modulating, and wherein the thermal energy from at least a portion of one of (i) engine lubricant, (ii) engine exhaust, and (iii) propellant, is used to reheat at least a portion of the cooling fluid prior to circulation back to the engine.

32. The method of claim 25, further comprising circulating, via a cooler configured between the expander and the condenser, cooling fluid to provide supplementary cooling to the organic propellant.

33. The method of claim 32, further comprising providing, via the reciprocating engine, cooling fluid to the cooler, and circulating, via a supplementary heat exchanger, at least a portion of the cooling fluid.

34. The method of claim 32, further comprising circulating, via an engine radiator, at least a portion of the cooling fluid from the cooler to the radiator to dissipate thermal energy transferred to the cooling fluid from the propellant at a supplementary heat exchanger.

35. The method of claim 32, further comprising circulating at least a portion of the cooling fluid from the cooler to a ground source heat exchange conduit to dissipate thermal energy transferred to the cooling fluid from the propellant at a supplementary heat exchanger.

36. The method of claim 25, further comprising cooling, via a cooling fan, system components, said system components comprising at least one of (i) the condenser, (ii) a radiator and (iii) a cooler, for circulating cooling fluid through the system to provide supplementary cooling capacity, and co-locating two or more system components in proximity to the cooling fan so as to be simultaneously cooled by the fan using one of (i) power from the reciprocating engine, (ii) power from the secondary power and (iii) power from a power hub.

37. A method for collecting and converting thermal energy to mechanical energy in a system, the method comprising:

providing primary power and thermal energy via a reciprocating engine, the thermal energy comprising engine exhaust and one or more non-exhaust sources of energy;

compressing natural gas within natural gas conduits via a natural gas compressor configured to provide a source of thermal energy;

collecting thermal energy, via a propellant heat exchanger comprising an evaporator of an Organic Rankine Cycle (ORC), from at least one of the natural gas compressor and thermal energy other than the engine exhaust from the reciprocating engine, collecting, via a superheater heat exchanger of the ORC, thermal energy directly or indirectly from the engine exhaust source of thermal energy;

collecting and using, via the ORC, at least one of (i) the one or more non-exhaust sources of thermal energy to heat and evaporate an organic propellant in the propellant heat exchanger, and (ii) the thermal energy from the natural gas compressor to heat and evaporate an organic propellant in the propellant heat exchanger;

superheating, via the superheater heat exchanger, the evaporated organic propellant using exhaust heat to drive an expander of the ORC in generating secondary power;

controlling, via a processor-based control module, a flow of the organic propellant to the propellant heat exchanger to match the flow of the organic propellant to a rate of evaporation in the propellant heat exchanger to provide only vapor for driving the expander; and condensing, via a condenser of the ORC, spent propellant from the expander into liquid form for recirculation to the propellant heat exchanger.

38. The method of claim 37, further comprising monitoring and controlling, via the processor-based control module, at least a portion of the thermal energy collected from the natural gas compressor or reciprocating engine by the ORC to control heat transfer of the organic propellant for secondary power generation.

39. The method of claim 37, further comprising transferring thermal energy, via at least one supplementary heat exchanger, from at least one of:

(i) engine exhaust, (ii) engine lubricating oil, (iii) engine auxiliary cooler, (iv) compressor lubricating oil, and (v) compressed natural gas to cooling fluid of the reciprocating engine.

40. The method of claim 39, further comprising transferring thermal energy, via the at least one supplementary heat exchanger, to the cooling fluid before the cooling fluid interfaces with the ORC.

41. The method of claim 39, further comprising circulating, via an engine radiator, at least a portion of the cooling fluid to the radiator to dissipate thermal energy transferred to the cooling fluid.

42. The method of claim 41, further comprising providing cooling fluid via the reciprocating engine, and circulating, via the engine radiator, at least a portion of the cooling fluid.

43. The method of claim 37, further comprising exchanging thermal energy in the reciprocating engine cooling fluid with the propellant heat exchanger to extract more thermal energy than is necessary from the cooling fluid to keep an engine thermostat in the reciprocating engine from modulating, and wherein the thermal energy from at least a portion of one of (i) compressor lubricating oil from the natural gas compressor, (ii) compressed natural gas, (iii) engine lubricant, (iv) engine exhaust, and (v) propellant, is used to reheat at least a portion of the cooling fluid prior to circulation back to the engine.

44. The method of claim 37, further comprising circulating, via a cooler configured between the expander and the condenser, cooling fluid to provide supplementary cooling to the organic propellant.

45. The method of claim 44, further comprising providing, via the reciprocating engine, cooling fluid to the cooler, and circulating, via a supplementary heat exchanger, at least a portion of the cooling fluid.

46. The method of claim 44, further comprising circulating, via an engine radiator, at least a portion of the cooling fluid from the cooler to an engine radiator to dissipate thermal energy transferred to the cooling fluid from the propellant at a supplementary heat exchanger.

47. The method of claim 44, further comprising circulating at least a portion of the cooling fluid from the cooler to a ground source heat exchange conduit to dissipate thermal energy transferred to the cooling fluid from the propellant at a supplementary heat exchanger.

48. The method of claim 37, further comprising cooling, via a cooling fan, system components, said system components comprising at least one of (i) the condenser, (ii) a radiator (iii) a cooler configured to circulate cooling fluid through the system to provide supplementary cooling capacity, (iv) engine auxiliary cooler, (v) compressor lubricant cooler, and (vi) natural gas cooling conduits, and co-locating two or more system components in proximity to the cooling fan so as to be simultaneously cooled by the fan using one of (i) power from the reciprocating engine, (ii) power from the secondary power and (iii) power from a power hub.

* * * * *